US010421467B2

(12) United States Patent
Gotlund et al.

(10) Patent No.: US 10,421,467 B2
(45) Date of Patent: Sep. 24, 2019

(54) SIDE FRAME FOR A RAILWAY TRUCK AND METHOD FOR MANUFACTURING SAME

(71) Applicant: Nevis Industries LLC, Wilmington, DE (US)

(72) Inventors: Erik L. Gotlund, Green Oaks, IL (US); Roshan N. Manibharathi, Des Plaines, IL (US)

(73) Assignee: Nevis Industries LLC, Wilmington, DE (US)

( * ) Notice: Subject to any disclaimer, the term of this patent is extended or adjusted under 35 U.S.C. 154(b) by 148 days.

(21) Appl. No.: 15/378,697

(22) Filed: Dec. 14, 2016

(65) Prior Publication Data

US 2018/0162420 A1 Jun. 14, 2018

(51) Int. Cl.
*B61F 5/52* (2006.01)

(52) U.S. Cl.
CPC ..... *B61F 5/52* (2013.01)

(58) Field of Classification Search
CPC ... B61F 5/52; B22C 9/02; B22C 9/088; B22C 9/22; B22C 9/12; B22C 9/24; B22D 25/02; B22D 25/06
See application file for complete search history.

(56) References Cited

U.S. PATENT DOCUMENTS

| | | | |
|---|---|---|---|
| 2,699,002 A | 1/1955 | Sylvestro | |
| 4,156,450 A | 5/1979 | Hunter | |
| 8,186,420 B2 | 5/2012 | Filip et al. | |
| 8,672,152 B2 | 3/2014 | Nibouar et al. | |
| 8,770,265 B2 | 7/2014 | Nibouar et al. | |
| 9,216,450 B2 | 12/2015 | Gotlund et al. | |
| 9,233,416 B2 | 1/2016 | Gotlund et al. | |
| 2004/0031413 A1* | 2/2004 | Smith | B61F 5/52 105/226 |
| 2012/0175905 A1 | 7/2012 | Mautino et al. | |
| 2012/0291661 A1* | 11/2012 | Gotlund | B22C 9/02 105/206.1 |
| 2012/0291662 A1 | 11/2012 | Gotlund et al. | |
| 2012/0291976 A1 | 11/2012 | Gotlund et al. | |
| 2012/0291977 A1 | 11/2012 | Gotlund et al. | |
| 2013/0025811 A1 | 1/2013 | Nibouar et al. | |
| 2013/0025815 A1 | 1/2013 | Nibouar et al. | |
| 2013/0168035 A1 | 7/2013 | Nibouar et al. | |

FOREIGN PATENT DOCUMENTS

| | | |
|---|---|---|
| CN | 201217069 Y | 4/2009 |
| CN | 202683953 U | 1/2013 |

OTHER PUBLICATIONS

Jun. 13, 2018—(WO) International Search Report and Written Opinion—App. PCT/US2017/066405.

* cited by examiner

*Primary Examiner* — Mark T Le
(74) *Attorney, Agent, or Firm* — Banner & Witcoff, Ltd.

(57) ABSTRACT

A side frame used in a railway car truck that has localized areas of increased strength and method of manufacturing the side frame. The side frame is manufactured with a plurality of risers positioned at various locations on the same side wall to enable regions of increased strength proximate the inboard corner of the pedestal jaws and the upper and lower corners of the bolster opening.

34 Claims, 10 Drawing Sheets

SIDE FRAME FOR A RAILWAY TRUCK AND METHOD FOR MANUFACTURING SAME

TECHNICAL FIELD

The disclosure relates generally to side frames for a railway car truck and more particularly to side frames having increased strength in specified areas.

BACKGROUND

Railway cars typically consist of a rail car that rests upon a pair of truck assemblies. The truck assemblies include a pair of side frames and wheelsets connected together via a bolster and damping system. The car rests upon the bowl portion at the center of the bolster, which acts as a point of rotation for the truck system. The car body movements are reacted through the springs and friction wedge dampers, which connect the bolster and side frames. The side frames include pedestals that each define a jaw into which a wheel assembly of a wheel set is positioned using a roller bearing adapter.

The side frames may be formed via various casting techniques. The most common technique for producing these components is through sand casting. High production manufacturing of side frames in this casting process leaves the products susceptible to defects making the product vulnerable to high operating stresses and fatigue cycles.

The side frames may have life cycle requirements of fifty years. However, while in use, the side frames undergo various loading situations particularly near the pedestals and the side frames connect to the bolster. A means to reduce porosity defects will increase the strength of the side frame in these areas may extend the life cycle of the side frame.

BRIEF SUMMARY

Aspects of this disclosure relate to a side frame for a railway car truck, where the side frame comprises a forward pedestal jaw and a rearward pedestal jaw, where the forward and rearward jaws configured for mounting wheel assemblies. The side frame may further have a center disposed substantially equally between the forward pedestal jaw and the rearward pedestal jaw, a first side wall and a second side wall, and a bolster opening with an upper bolster opening surface, a lower spring seat surface, a forward surface, and a rearward surface. The side frame may also have a first riser arranged on the first side wall proximate to a forward lower corner of the bolster opening, a second riser arranged on the first side wall proximate to a rearward lower corner of the bolster opening, a third riser arranged on the first side wall proximate to a forward upper corner of the bolster opening, a fourth riser arranged on the first side wall proximate to a rearward upper corner of the bolster opening, a fifth riser arranged on the first side wall proximate to an upper inboard corner of a forward pedestal jaw, and a sixth riser arranged on the first side wall proximate to an upper inboard corner of a rearward pedestal jaw, where a thickness of the first side wall may be greater than a thickness of the second side wall proximate each of the first riser, the second riser, the third riser, the fourth riser, the fifth riser, and the sixth riser.

Additional aspects of this disclosure may relate to the side frame where a center of the first riser may be arranged between about 12.38 inches and 15.38 inches forward of the center and between about −0.5 inches and 2.5 inches above the lower spring seat surface of the bolster opening, a center of the second riser may be arranged between about 12.38 inches and 15.38 inches rearward of the center and between about −0.5 inches and 2.5 inches above the lower spring seat surface of the bolster opening, a center of the third riser may be arranged between about 8.75 inches and 11.75 inches forward of the center and between about 15.57 inches and 18.57 inches above the lower spring seat surface of the bolster opening, a center of the fourth riser may be arranged between about 8.75 inches and 11.75 inches rearward of the center and between about 15.57 inches and 18.57 inches above the lower spring seat surface of the bolster opening, a center of the fifth riser may be arranged between about 26.50 inches and 29.50 inches forward of the center and between about 12.50 inches and 15.50 inches above the lower spring seat surface of the bolster opening, and a center of the sixth riser may be arranged between about 26.50 inches and 29.50 inches rearward of the center and between about 12.50 inches and 15.50 inches above the lower spring seat surface of the bolster opening.

Still other aspects of this disclosure may relate to a side frame for a railway car truck where a center of the first riser may be arranged between about 11.88 inches and 14.88 inches forward of the center and between about −0.63 inches and 2.37 inches above the lower spring seat surface of the bolster opening, a center of the second riser may be arranged between about 11.88 inches and 14.88 inches rearward of the center and between about −0.63 inches and 2.37 inches above the lower spring seat surface of the bolster opening, a center of the third riser may be arranged between about 9.75 inches and 12.75 inches forward of the center and between about 16.78 inches and 19.78 inches above the lower spring seat surface of the bolster opening, a center of the fourth riser may be arranged between about 9.75 inches and 12.75 inches rearward of the center and between about 16.78 inches and 19.78 inches above the lower spring seat surface of the bolster opening, a center of the fifth riser may be arranged between about 27.57 inches and 30.57 inches forward of the center and between about 16.13 inches and 19.13 inches above the lower spring seat surface of the bolster opening, and a center of the sixth riser may be arranged between about 27.57 inches and 30.57 inches rearward of the center and between about 16.13 inches and 19.13 inches above the lower spring seat surface of the bolster opening.

Yet other aspects of this disclosure relate to a side frame for a railway car truck where a center of the first riser may be arranged between about 12.50 inches and 15.50 inches forward of the center and between about 0.13 inches and 3.13 inches above the lower spring seat surface of the bolster opening, a center of the second riser may be arranged between about 12.50 inches and 15.50 inches rearward of the center and between about 0.13 inches and 3.13 inches above the lower spring seat surface of the bolster opening, a center of the third riser may be arranged between about 9.44 inches and 12.44 inches forward of the center and between about 16.88 inches and 19.88 inches above the lower spring seat surface of the bolster opening, a center of the fourth riser may be arranged between about 9.44 inches and 12.44 inches rearward of the center and between about 16.88 inches and 19.88 inches above the lower spring seat surface of the bolster opening, a center of the fifth riser may be arranged between about 27.75 inches and 30.75 inches forward of the center and between about 16.81 inches and 19.81 inches above the lower spring seat surface of the bolster opening, and a center of the sixth riser may be arranged between about 27.75 inches and 30.75 inches rearward of the center and between about 16.81 inches and 19.81 inches above the lower spring seat surface of the bolster opening.

Still other aspects of this disclosure may relate to a side frame for a railway car truck that comprises a forward pedestal jaw and a rearward pedestal jaw configured for mounting wheel assemblies, where the side frame has a center disposed substantially equally between the forward pedestal jaw and the rearward pedestal jaw, a first side wall and a second side wall, a bolster opening having an upper bolster opening surface, a lower spring seat surface, a forward surface, and a rearward surface, and a plurality of risers arranged on the first side wall, where a thickness of the first side wall is greater than a thickness of the second side wall proximate each of the plurality of risers. The side frame for a railway car truck may further comprise a bolster opening wall defining the bolster opening and forming the upper bolster opening surface, the lower spring seat surface, the forward surface of the bolster opening, and the rearward surface of the bolster opening, wherein a thickness of at least a portion of the bolster opening wall is greater adjacent the first side wall than the thickness of the bolster opening wall in a central portion of the bolster opening wall.

Yet another aspect of this disclosure may relate to a side frame for a railway car truck where the thickness of the bolster opening wall proximate the forward and rearward lower corners of the bolster opening adjacent the first side wall may be between about 1.70 inches and 2.20 inches and the thickness of the bolster opening wall proximate the forward and rearward lower corners of the bolster opening in a central portion of the bolster opening wall may be between about 1.05 inches and 1.55 inches. Also, the side frame for a railway car truck where the thickness of the bolster opening wall proximate the forward and rearward lower corners of the bolster opening adjacent the first side wall may be between about 2.01 inches and 2.51 inches, and the thickness of the bolster opening wall proximate the forward and rearward lower corners of the bolster opening in a central portion of the bolster opening wall may be between about 1.80 inches and 2.30 inches. In addition, the side frame may have a thickness of the bolster opening wall proximate the forward and rearward lower corners of the bolster opening adjacent the first side wall between about 2.22 inches and 2.72 inches, and a thickness of the bolster opening wall proximate the forward and rearward lower corners of the bolster opening in a central portion of the bolster opening wall between about 1.76 inches and 2.26 inches.

In still other aspects this disclosure may relate to a side frame for a railway car truck where a thickness of the first side wall proximate the forward and rearward lower corners of the bolster opening may be greater than the thickness of the first side wall proximate the forward and rearward lower corners of the bolster opening and adjacent a bottom wall of the side frame. The side frame for a railway car truck may also have a thickness of the first side wall proximate the forward and rearward lower corners of the bolster opening and adjacent the bolster opening wall between about 0.88 inches and 1.38 inches, and a thickness of the first side wall proximate the forward and rearward lower corners of the bolster opening and adjacent a bottom wall of the side frame between about 0.53 inches and 1.03 inches. Optionally, the side frame for a railway car truck may have a thickness of the first side wall proximate the forward and rearward lower corners of the bolster opening and adjacent the bolster opening wall may be between about 1.30 inches and 1.80 inches and a thickness of the first side wall proximate the forward and rearward lower corners of the bolster opening and adjacent a bottom wall of the side frame between about 1.03 inches and 1.53 inches. As another option, the side frame may have a thickness of the first side wall proximate the forward and rearward lower corners of the bolster opening and adjacent the bolster opening wall between about 1.02 inches and 1.52 inches and a thickness of the first side wall proximate the forward and rearward lower corners of the bolster opening and adjacent a bottom wall of the side frame between about 0.61 inches and 1.11 inches.

Still other embodiments may relate to a side frame having a thickness of the bolster opening wall proximate the forward and rearward upper corners of the bolster opening adjacent the first side wall between about 0.48 inches and 0.98 inches, and a thickness of the bolster opening wall proximate the forward and rearward upper corners of the bolster opening in a central portion of the bolster opening wall between about 0.39 inches and 0.89 inches. The side frame may also have a thickness of the bolster opening wall proximate the forward and rearward upper corners of the bolster opening adjacent the first side wall is between about 1.13 inches and 1.63 inches, and a thickness of the bolster opening wall proximate the forward and rearward upper corners of the bolster opening in a central portion of the bolster opening wall between about 0.95 inches and 1.45 inches. The side frame may also have a thickness of the bolster opening wall proximate the forward and rearward upper corners of the bolster opening adjacent the first side wall is between about 1.71 inches and 2.21 inches, and a thickness of the bolster opening wall proximate the forward and rearward upper corners of the bolster opening in a central portion of the bolster opening wall between about 1.17 inches and 1.67 inches. The side frame may have a thickness of the first side wall proximate the forward and rearward upper corners of the bolster opening that may be greater than the thickness of the first side wall proximate the forward and rearward upper corners of the bolster opening and adjacent a top wall of the side frame. The side frame may be a thickness of the first side wall proximate the forward and rearward upper corners of the bolster opening and adjacent the bolster opening side wall between about 0.96 inches and 1.46 inches, and a thickness of the first side wall proximate the forward and rearward upper corners of the bolster opening and adjacent a top wall of the side frame between about 0.26 inches and 0.76 inches. The side frame may have a thickness of the first side wall proximate the forward and rearward upper corners of the bolster opening and adjacent the bolster opening side wall between about 0.79 inches and 1.29 inches, and a thickness of the first side wall proximate the forward and rearward upper corners of the bolster opening and adjacent a top wall of the side frame between about 0.32 inches and 0.82 inches. The side frame may also have a thickness of the first side wall proximate the forward and rearward upper corners of the bolster opening and adjacent the bolster opening side wall between about 0.74 inches and 1.24 inches, and a thickness of the first side wall proximate the forward and rearward upper corners of the bolster opening and adjacent a top wall of the side frame between about 0.25 inches and 0.75 inches.

Yet in other embodiments of the side frame may have a forward pedestal jaw wall and a rearward pedestal jaw wall defining the respective forward and rearward pedestal jaws, where a thickness of at least a portion of the pedestal jaw walls may be greater adjacent the first side wall than the thickness of the pedestal jaw walls adjacent the second side wall. The side frame may have a thickness of the pedestal jaw walls proximate the inboard corners of the pedestal jaws adjacent the first side wall is between about 1.75 inches and 2.25 inches, and a thickness of the pedestal jaw walls proximate the inboard corners of the pedestal jaws in a central portion of the pedestal jaw walls is between about 1.32 inches and 1.82 inches. The side frame may have a thickness of the pedestal jaw walls proximate the inboard corners of the pedestal jaws adjacent the first side wall is between about 1.89 inches and 2.39 inches, and the thickness of the pedestal jaw walls proximate the inboard corners of the pedestal jaws in a central portion of the pedestal jaw walls between about 1.75 inches and 2.25 inches. The side frame may additionally have a thickness of the pedestal jaw walls proximate the inboard corners of the pedestal jaws adjacent the first side wall is between about 2.54 inches and 3.04 inches, and a thickness of the pedestal jaw walls proximate the inboard corners of the pedestal jaws in a central portion of the pedestal jaw walls between about 1.47 inches and 1.97 inches. Additionally, the thickness of the first side wall proximate the inboard corners of the pedestal jaws may be greater than the thickness of the first side wall proximate the inboard corners of the pedestal jaws adjacent a top wall of the side frame. Optionally, the thickness of the first side wall proximate the inboard corners of the pedestal jaws and adjacent the pedestal jaw walls may be between about 1.18 inches and 1.68 inches, and the thickness of the first side wall proximate the inboard corners of the pedestal jaws and adjacent a top wall of the side frame may be between about 0.77 inches and 1.27 inches. In some embodiments, the thickness of the first side wall proximate the inboard corners of the pedestal jaws and adjacent the pedestal jaw walls may be between about 1.44 inches and 1.94 inches, and the thickness of the first side wall proximate the inboard corners of the pedestal jaws and adjacent a top wall of the side frame may be between about 0.36 inches and 0.86 inches. Also, the thickness of the first side wall proximate the inboard corners of the pedestal jaws and adjacent the pedestal jaw walls may be between about 1.43 inches and 1.93 inches, and the thickness of the first side wall proximate the inboard corners of the pedestal jaws and adjacent a top wall of the side frame may be between about 0.47 inches and 0.97 inches.

Still other embodiments of this disclosure may relate to a side frame for a railway car truck, the side frame that comprises a plurality of risers arranged on the first side wall, where a thickness of the first side wall may be greater than a thickness of the second side wall proximate each of the plurality of risers, a thickness of at least a portion of the bolster opening wall may be greater adjacent the first side wall than the thickness of the bolster opening wall in a central portion of the bolster opening wall, and a thickness of at least a portion of the pedestal jaw wall may be greater adjacent the first side wall than the thickness of the pedestal jaw wall adjacent the second side wall. Additionally, a ratio of the thickness of the bolster opening wall proximate the forward and rearward lower corners of the bolster opening adjacent the first side wall to the ratio of the thickness of the bolster opening wall proximate the forward and rearward lower corners of the bolster opening in a central portion of the bolster opening wall is between about 1.05:1 and 1.73:1, and a ratio of the thickness of the first side wall proximate the forward and rearward lower corners of the bolster opening and adjacent the bolster opening wall to the thickness of the first side wall proximate the forward and rearward lower corners of the bolster opening and adjacent a bottom wall of the side frame is between about 1.05:1 and 1.71:1. Alternatively, a ratio of the thickness of the bolster opening wall proximate the forward and rearward upper corners of the bolster opening adjacent the first side wall to the thickness of the bolster opening wall proximate the forward and rearward upper corners of the bolster opening in a central portion of the bolster opening wall is between about 1.05:1 and 1.59:1, and a ratio of the thickness of the first side wall proximate the forward and rearward upper corners of the bolster opening and adjacent the bolster opening side wall to the thickness of the first side wall proximate the forward and rearward upper corners of the bolster opening and adjacent a top wall of the side frame is between about 1.55:1 and 2.73:1. In another option, the side frame may have a ratio of thickness of the pedestal jaw walls proximate the inboard corners of the pedestal jaws adjacent the first side wall to the thickness of the pedestal jaw walls proximate the inboard corners of the pedestal jaws in a central portion of the pedestal jaw walls between about 1.05:1 and 1.86:1, and a ratio of the thickness of the first side wall proximate the inboard corners of the pedestal jaws and adjacent the pedestal jaw walls to the thickness of the first side wall proximate the inboard corners of the pedestal jaws and adjacent an a top wall of the side frame is between about 1.18:1 and 3.20:1.

BRIEF DESCRIPTION OF THE DRAWINGS

The accompanying drawings are included to provide a further understanding of the claims, are incorporated in, and constitute a part of this specification. The detailed description and illustrated embodiments described serve to explain the principles defined by the claims.

DETAILED DESCRIPTION OF THE DRAWINGS

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three dimensional orientation of structures in order to fall within the scope of this invention. The reader is advised that the attached drawings are not necessarily drawn to scale.

The following terms are used in this specification, and unless otherwise noted or clear from the context, these terms have the meanings provided below.

"Plurality," as used herein, indicates any number greater than one, either disjunctively or conjunctively, as necessary, up to an infinite number.

"Proximate" as used herein, means that a first feature is located within a range +/−1 inch of a second feature.

"Substantially constant" as used herein, when referring to a dimension means that a value is approximately the same and varies no more than +/−5%.

Figure 1A:
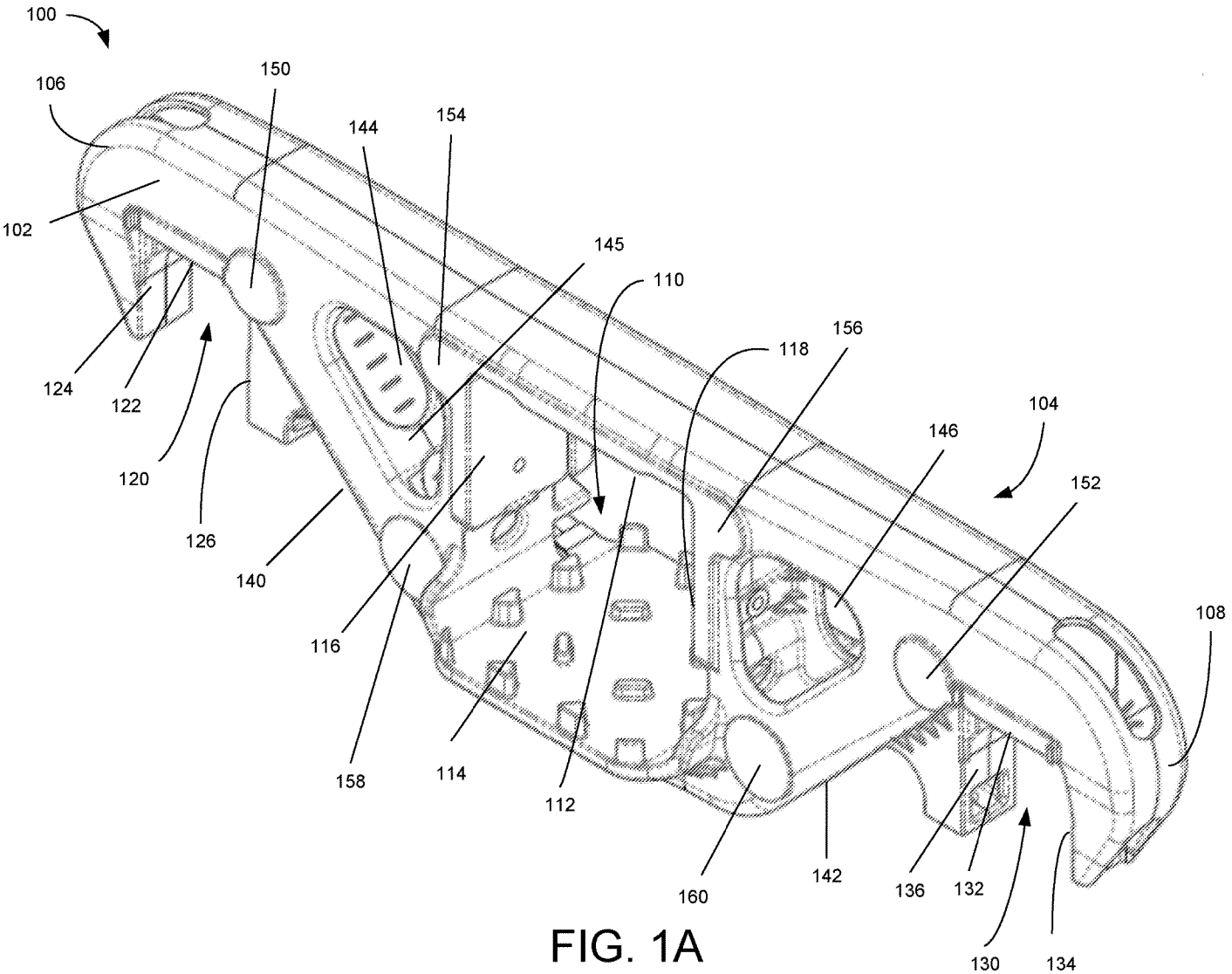
FIG. 1A illustrates a perspective view of an exemplary side frame for a 70 ton capacity truck as described in this disclosure.
Figure 1B:
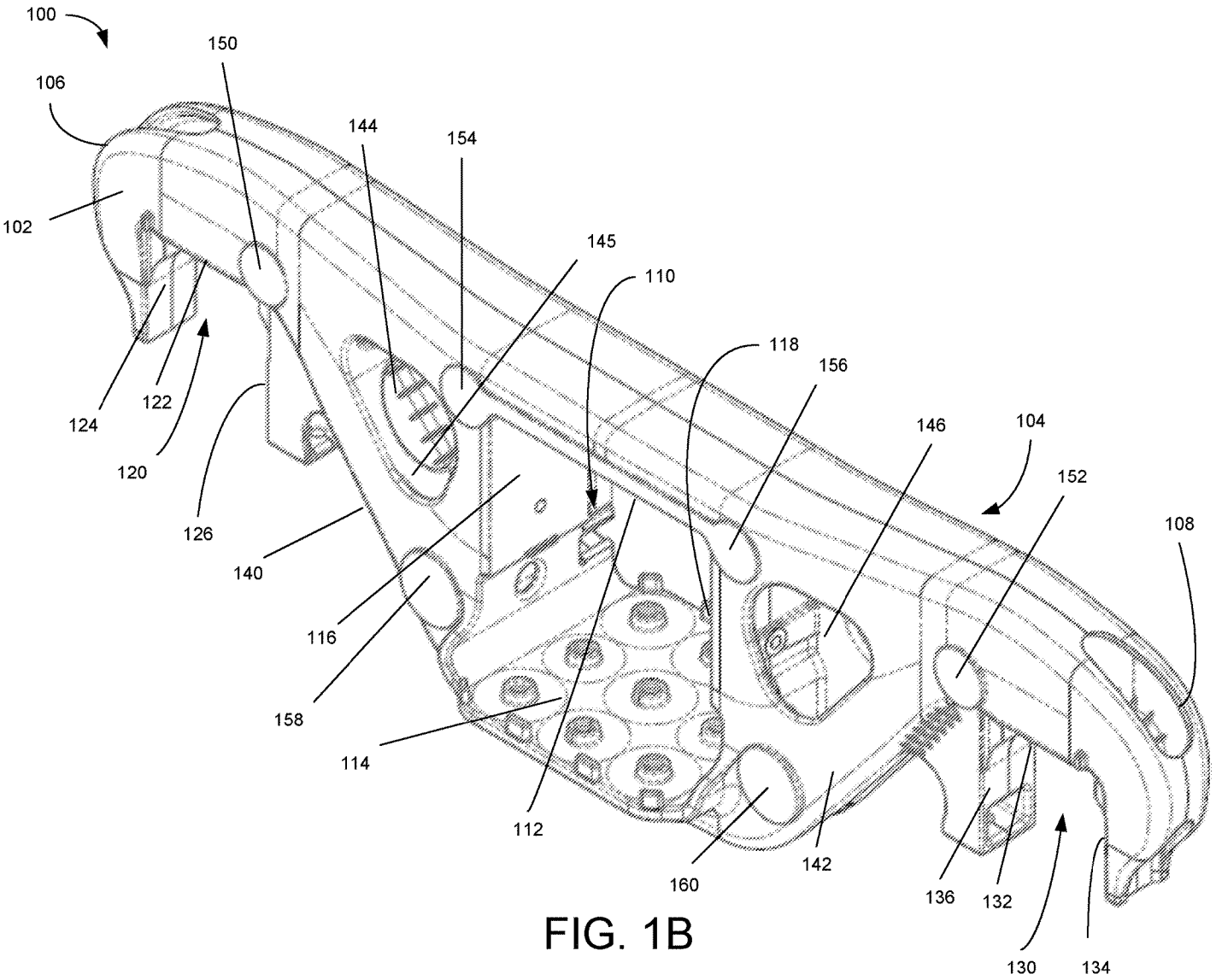
FIG. 1B illustrates a perspective view of an exemplary side frame for a 110 ton capacity truck as described in this disclosure.
Figure 1C:
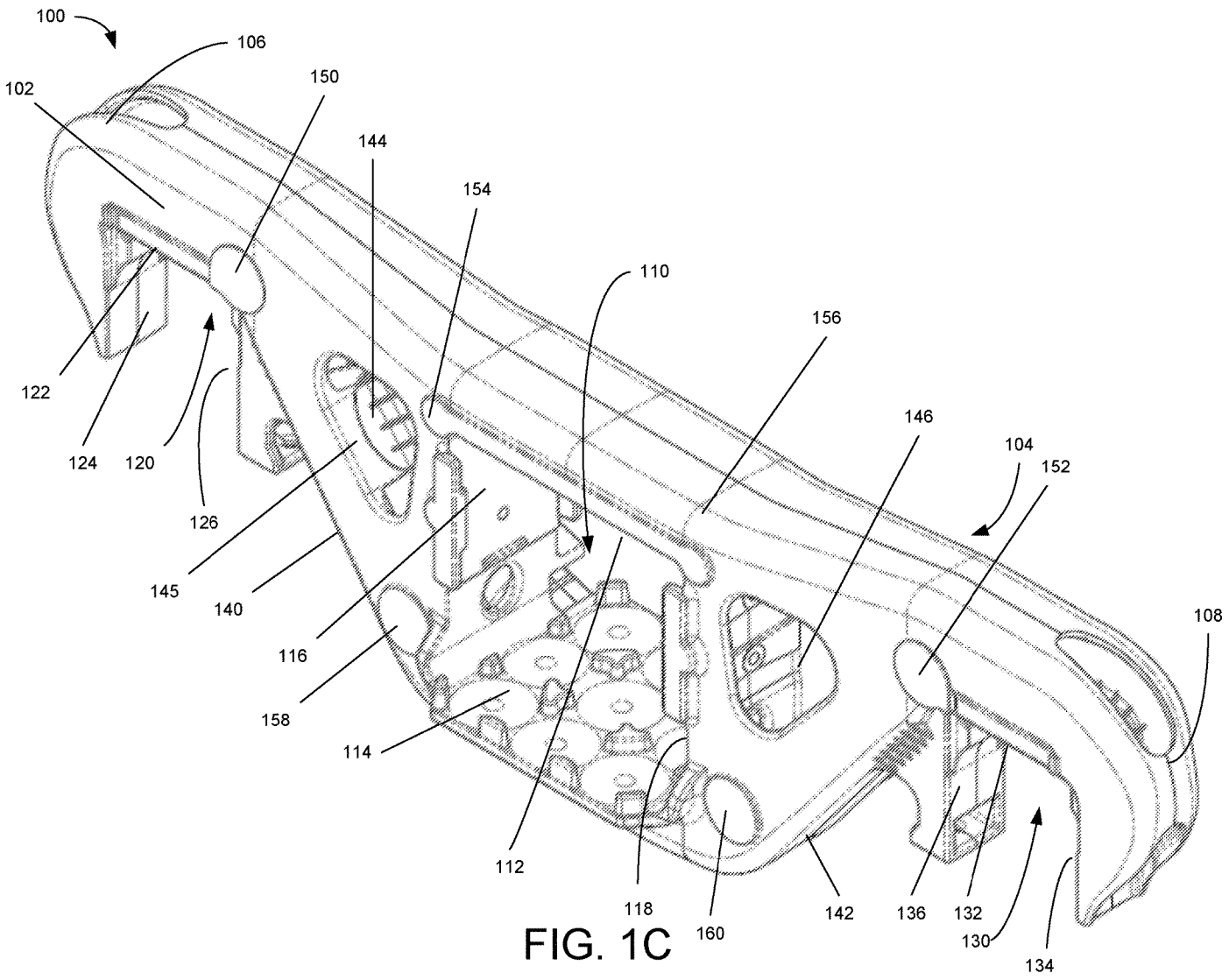
FIG. 1C illustrates a perspective view of an exemplary side frame for a 125 ton capacity truck as described in this disclosure.
Figure 2:
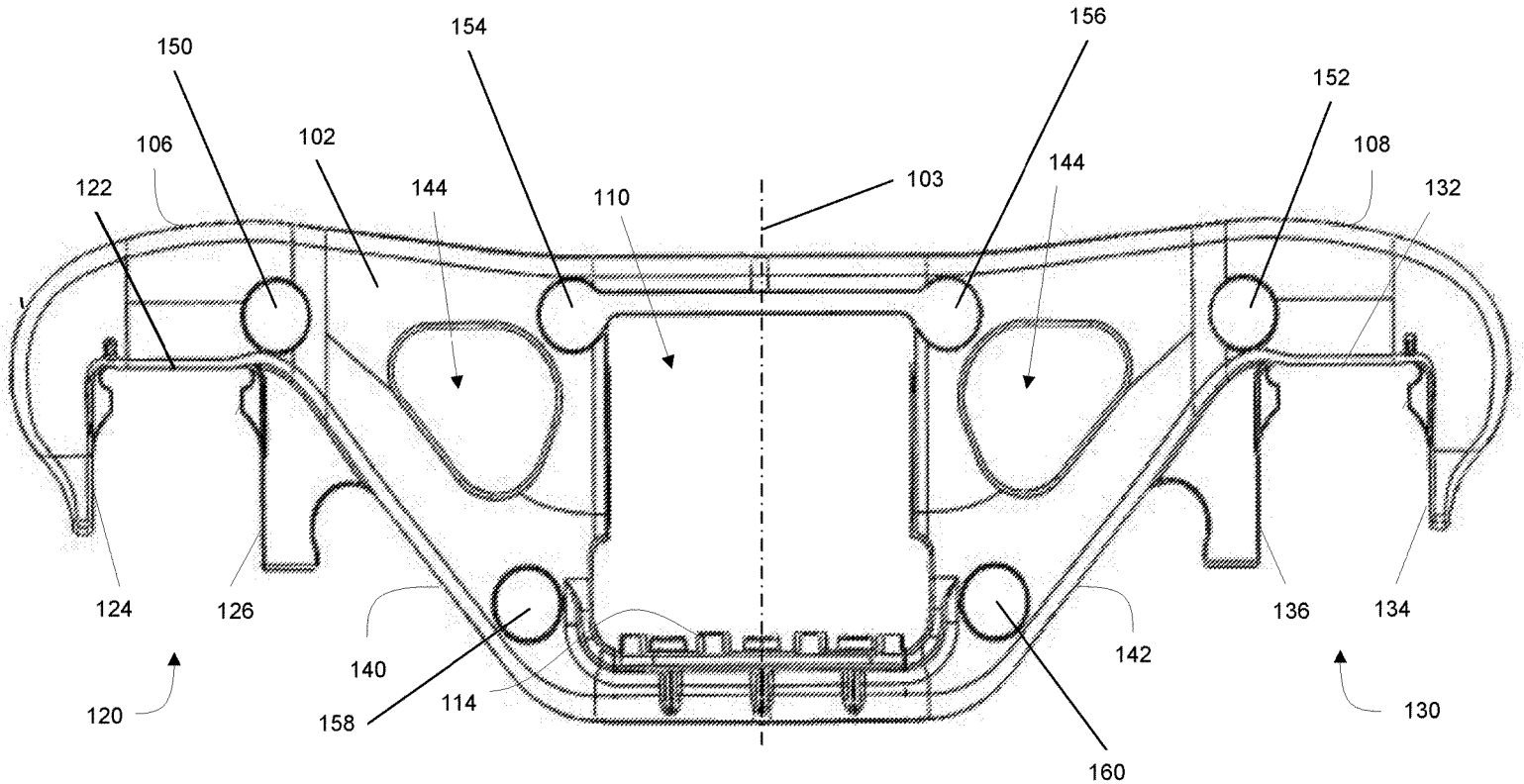
FIG. 2 illustrates a side view of the exemplary side frame.

FIGS. 1 and 2 illustrate an exemplary side frame 100 of a railway car truck. The railway car may correspond to a freight car, such as those utilized in the United States for carrying cargo in excess of 220,000 lbs. Gross Rail Load. The side frame 100 may include a first side wall 102, a second side wall 104, a forward pedestal 106 and a rearward pedestal 108, and a bolster opening 110. The forward and rearward pedestals 106, 108 are configured for mounting the wheel assemblies (not shown). The side frame 100 may have a center disposed substantially equally between the forward pedestal 106 and the rearward pedestal 108, defined as lateral centerline 103. The bolster opening 110 may have an upper bolster opening surface 112, a lower spring seat surface 114, a forward surface 116, and a rearward surface 118. The forward pedestal 106 may have a forward pedestal jaw 120 with a forward pedestal roof wall 122, and forward and rearward pedestal jaw walls 124, 126, respectively. Similarly, the rearward pedestal 108 may have a rearward pedestal jaw 130 with a rearward pedestal roof wall 132, and forward and rearward pedestal jaw walls 134, 136, respectively.

The side frame 100 may further comprise forward and rearward diagonal tension members 140, 142 connecting the lower spring seat surface 114 to the forward and rearward pedestals 106, 108. A pair of forward column windows 144 and rearward column windows 146 may extend through the first side wall 102 and second side wall 104.

FIGS. 1 and 2 also illustrate the locations of a plurality of risers that were substantially removed during the manufacturing process. For example, a pair of pedestal jaw risers 150, 152 may be arranged on the first side wall 102. Riser 150 may be located proximate to an upper inboard corner of a forward pedestal jaw 120. Riser 152 may be located proximate to an upper inboard corner of a rearward pedestal jaw 130. Additionally, a pair of upper corner bolster opening risers 154, 156 may be arranged on the first side wall 102, where riser 154 may be located proximate an a forward upper corner of the bolster opening 110 and riser 156 may be located proximate a rearward upper corner of the bolster opening 110. Further, a pair of lower bolster opening risers 158, 160 may be arranged on the first side wall 102, where riser 158 may be located proximate a forward lower corner of the bolster opening 110 and riser 160 may be located proximate a rearward lower corner of the bolster opening.

Figure 3:
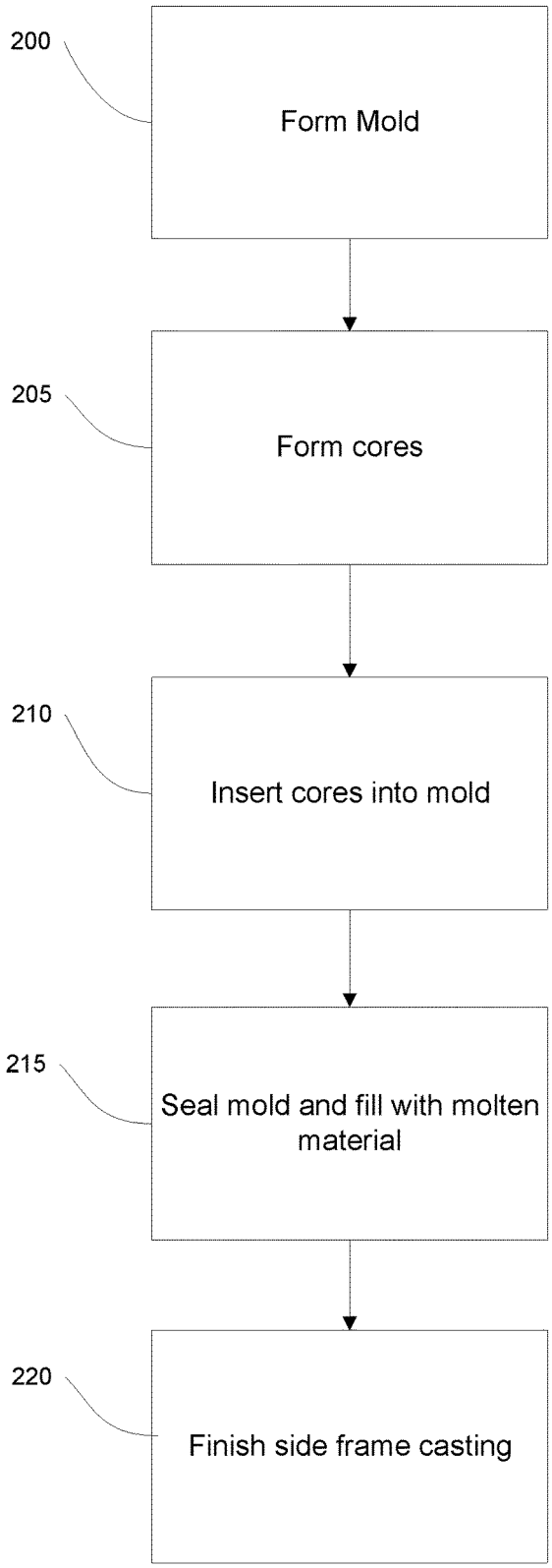
FIG. 3 illustrates exemplary operations for manufacturing a side frame.

FIG. 3 illustrates exemplary operations for manufacturing the side frame 100 described above.

At block 200, a mold for manufacturing the side frame 100 may be formed. The mold may include a first or drag portion and a second or cope portion. The first or drag portion of the mold may include a cavity formed in the shape of the first or drag side of the side frame 100. The second or cope portion may include a cavity formed in the shape of the second or cope side of the side frame 100.

The respective portions may be formed by first providing first and second patterns that define an outside perimeter of the first or drag side and second or cope side, respectively, of the side frame 100. The patterns may partially define one or more feed paths for distribution of molten material within the mold.

Figure 4A:
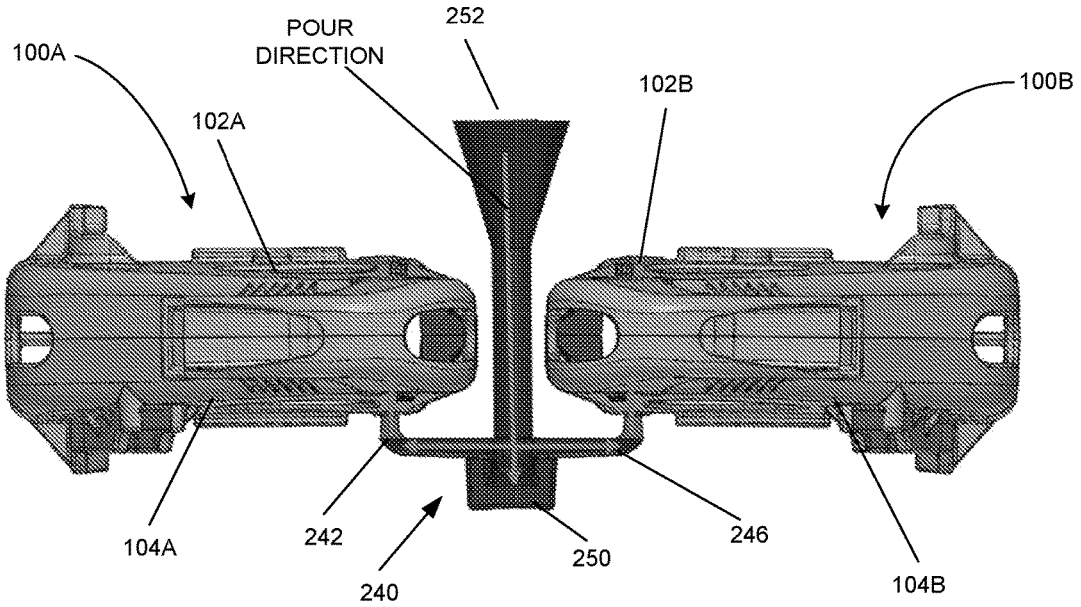
FIG. 4A illustrates a side view of an exemplary gating configuration for manufacturing side frames.
Figure 4B:
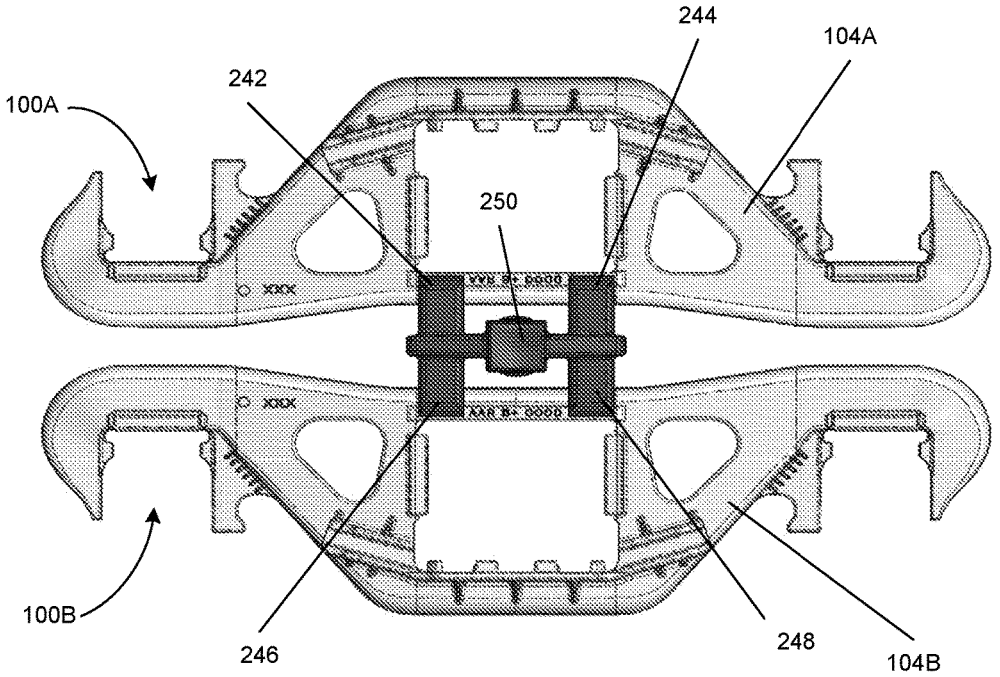
FIG. 4B illustrates a bottom view of the exemplary gating configuration of FIG. 4A.

For example, FIGS. 4A and 4B show an example of a pair of side frames 100A, 100B that are formed at the same time. FIGS. 4A and 4B show the pair of side frames 100A, 100B in an "as cast" condition before the feed path 240 is removed from the cast side frames 100A, 100B. The feed path 240 may comprise a plurality of runners and in-gates 242, 244 that flow into the second side wall 104A of side frame 100A and a plurality of runners and in-gates 246, 248 that flow into the second side wall 104B of side frame 100B. The plurality of runners and in-gates 242, 244, 246, 248 may connect to a well 250 located below the side frames 100A, 100B. The pour location 252 may be located above the well 250 and above the first side walls 102A, 102B of the side frames 100A, 100B. The molten metal flows in a downward direction from the pour location 252 into the well 250 and then flows in an upward direction through the runners and in-gates 242, 244, 246, 248 to fill the cavity created in the mold from the cope, drag, and side frame cores to form the side frames 100A, 100B. As the molten metal solidifies the runners and in-gates 242, 244, 246, 248 and well 250 form with the side frames 100A, 100B and are then removed at the during step 220 discussed later.

The runners and in-gates 242, 244, 246, 248 may be located near the center portion of the side frames 100A, 100B and may be individually connected to the second side surface 104A, 104B of their respective side frames 100A, 100B.

The side frames 100A, 100B are positioned in a manner such that the first side walls 102A, 102B are oriented in the same direction as if mirrored across a plane centered through the well 250. This orientation allows the side frames 100A, 100B to form in a similar manner since the feed path is identical for each side frame 110A, 100B.

At block 205, a side frame core (not shown) that may define the interior region of the side frame 100. The side frame core may include one or more portions to form the interior features of the side frame 100.

The side frame core may be formed by any known method. In one example, the side frame core may be formed by a core box that includes a cope and drag portions that define the side frame core. Molding sand may be inserted into the core box and cured. The core box may then be removed to reveal the cured core. The side frame core may be formed individually, integrally, or in some combination thereof. The side frame core may be formed as two or more portions. For example, the side frame core may include a cope portion and a drag portion formed separately in separate core boxes (i.e., a cope mold and drag mold). After curing, the formed portions may be attached. For example, the cope and drag portions of a given core may be glued together to form the side frame core.

At block 210, the side frame core may be inserted in the mold and the side frame 100 is cast. For example, the side frame core may be inserted into the first or drag portion of the mold. The second or cope portion may be placed over the first portion and secured to the first portion via clamps, straps, and the like. In this regard, locating features may be formed in the first portion and the second portion to ensure precise alignment of the respective portions.

The mold may also include a plurality of risers that are integrally formed with and arranged on the first side 102 of the side frame 100. The risers may be hollow structures into which molten material fills during casting operations. The risers may be positioned at areas of the mold that correspond to thicker areas of the side frame that cool more slowly than other areas of the side frame 100. The risers may function as reservoirs of molten material that compensate for contraction that occurs in the molten material as the molten material cools, and thus may prevent shrinkage, or hot tearing of the cast side frame 100 in the thicker areas that might otherwise occur. The risers may be formed in the pattern or may be placed in the pattern before molding. Additionally, the risers may have any shape such as a tubular shape, elliptically shaped, side feeding, or conical shaped. Risers may be created from a material which insulates heat, or exothermic material which generates heat, or formed in the same material as the mold. As another option, the risers may be vented to the atmosphere or blind where they are not vented to the atmosphere. Exemplary risers 150, 152, 154, 156, 158, 160 are illustrated on side frame 100 in FIGS. 5, 6A, 7A, and 8A.

The risers 150, 152, 154, 156, 158, 160 may be optimized in size to provide an optimal amount of feeding material during solidification of the molten material to prevent the formation of shrinkage voids and hot tears in critical areas of the side frame 100. The risers 150, 152, 154, 156, 158, 160 combined with the localized geometry of the side frame 100 around the risers 150, 152, 154, 156, 158, 160 may encourage directional solidification of the side frame 100 where the molten material begins to solidify in the regions of lowest temperature which may be furthest away from the feed and riser locations and then the solidification of the molten material moves in a direction toward regions of the highest temperature which may be nearest the feed and riser locations. As the molten material solidifies in a dendritic manner toward the riser locations, the molten material that solidifies last may contain regions of increased shrinkage and porosity compared to the regions that solidified first. Thus, the risers 150, 152, 154, 156, 158, 160 combined with the localized geometry of the side frame 100 around the risers 150, 152, 154, 156, 158, 160 may create localized regions of increased solidity, reduced porosity, and improved strength within the regions of the casting where the molten material solidified first compared to the regions where the molten material solidified last nearest or within the risers 150, 152, 154, 156, 158, 160. Accordingly, the side frame 100 may comprise localized regions of greater solidity, reduced porosity, and increased strength shown as darkened regions "Z," which are fed by the risers 150, 152, 154, 156, 158, 160, shown in FIGS. 6A, 7A, and 8A.

The side frame 100 may be x-rayed, ultrasonically tested, CT scanned, or examined using other non-destructive test methods to quantify the size of defects present in the casting. X-rays may be taken in accordance with ASTM E94-04 (2010) "Standard Guide for Radiographic Examination," which is incorporated by reference, or other methods of examination. The radiographic films may be graded and examined in accordance with ASTM E446-15 "Standard Reference Radiographs for Steel Castings Up to 2 in. (50.8 mm) in Thickness," or ASTM E186-15 "Standard Reference Radiographs for Heavy-Walled (2 to 412 in. (50.8 to 114 mm)) Steel Castings," which are both incorporated by reference. Using the dimensions contained herein in concert with the risers to feed these areas may result in maximum shrinkage defect sizes of in accordance with a Level 2. In most cases, shrinkage defects are less than Level 1 when compared to American Association of Railroads (AAR) Manual of Standards and Recommended Practices (MSRP), Specification M-210 (Dated 2013) criteria, which is incorporated by reference, the solidity standard may meet or exceed Class 1.

Although, the risers may have any shape, the risers 150, 152, 154, 156, 158, 160 may be exothermic blind risers having a generally truncated conical shape with an upper and lower diameter and a tapered surface between the two diameters. For example, the pedestal jaw risers 150, 152 may have a lower diameter 170 at a first end near the first side wall 102 and an upper diameter 172 at a second end opposite the first end, such that the lower diameter 170 may be greater than the upper diameter 172. Similarly, the upper corner bolster opening risers 154, 156 may have a lower diameter 174 at a first end near the first side wall 102 and an upper diameter 176 at a second end opposite the first end, such that the lower diameter 174 may be greater than the upper diameter 176. In addition, the lower bolster opening risers 158, 160 may have a lower diameter 178 at a first end near the first side wall 102 and an upper diameter 180 at a second end opposite the first end, such that the lower diameter 178 may be greater than the upper diameter 180. The lower diameter 170 of the pedestal jaw risers 150, 152 may be the same size as the lower diameter 178 of the lower bolster opening 158, 160, while the lower diameter 174 of the upper corner bolster opening risers 154, 156 may have a smaller diameter than either of the pedestal jaw risers 150, 152 or the lower bolster opening risers 158, 160.

At block 215, after securing the respective portions, molten material, such as molten steel, may be poured into the mold. The molten material may flow through the gating and throughout the mold in the space between the mold and the side frame core. The side frame 100 may be formed from a carbon steel alloy that meets or exceeds the AAR MSRP, Specification M-201 (Dated Jan. 21, 2016), which is incorporated by reference, Grade B+ or alternatively meeting a Grade B, Grade C or similar steel alloy. Optionally, this same specification would apply if the side frame 100 is cast from a ductile iron.

At block 220, the side frame 100 is removed from the mold, and the side frame 100 is finished. For example, any solidified material in the gating or risers may be removed. In some implementations, the mold may be configured so that a wedge or recess is formed in riser material just beyond an exterior surface of the side frame 100. The wedge or recess may enable hammering the riser material off, rather than more time consuming flame cutting utilized in known casting operations.

FIGS. 5, 6A, 7A, and 8A illustrate the side frame 100 in a partial as cast condition. The term "as cast" refers to the side frame 100 as the part is removed from the mold while still having risers and other features that are removed prior to the use of the side frame 100 on the railway car or lacking additional features (such as machined holes or surfaces) needed for use on the railway car.

Figure 5:
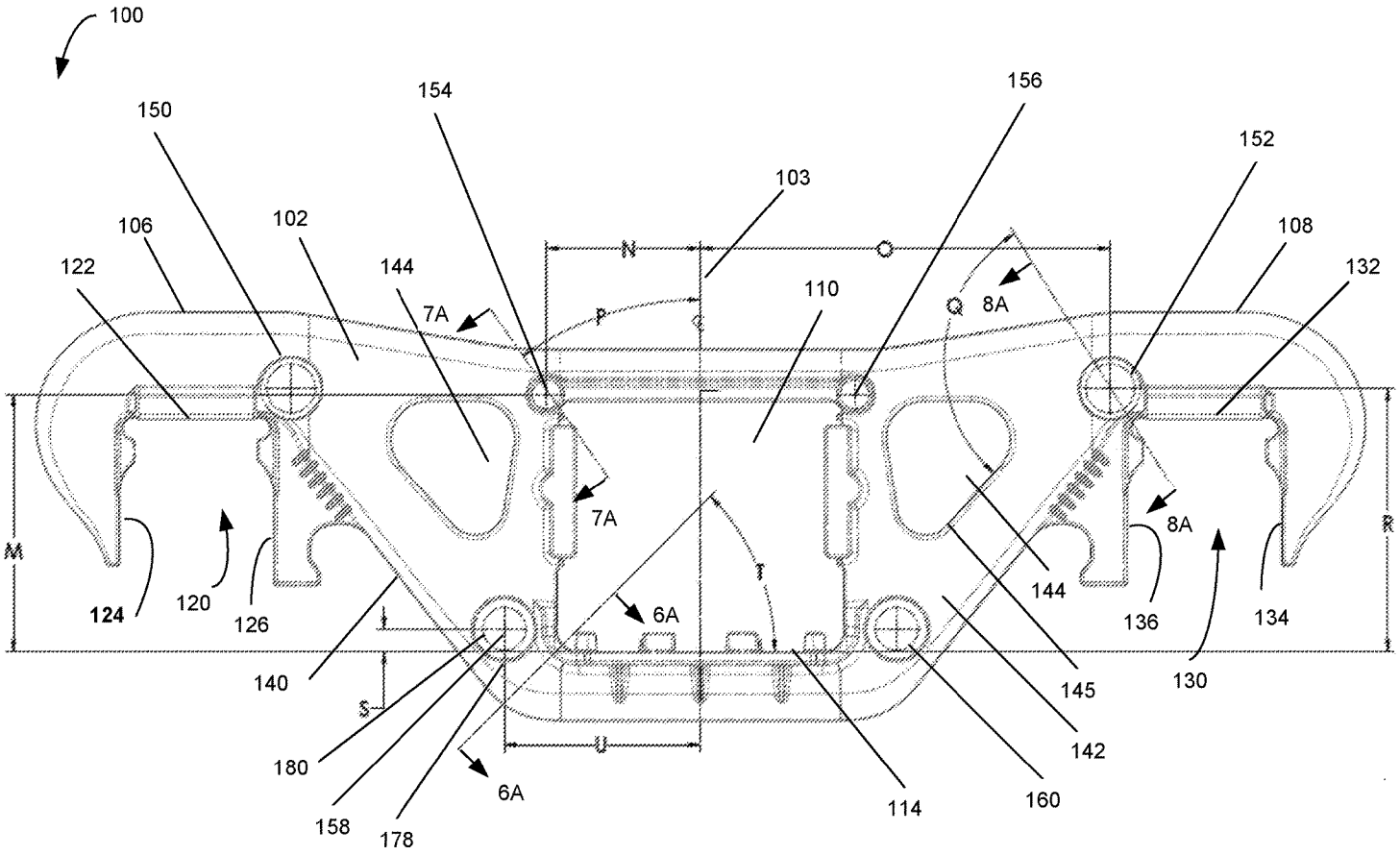
FIG. 5 illustrates a side view of the exemplary side frame.

As previously discussed, FIG. 5 shows a pair of pedestal jaw risers 150, 152 arranged on the first side wall 102. Riser 150 may be located proximate to an upper inboard corner of a forward pedestal jaw 120. Riser 152 may be located proximate to an upper inboard corner of a rearward pedestal jaw 130. Additionally, a pair of upper corner bolster opening risers 154, 156 may be arranged on the first side wall 102, where riser 154 may be located proximate an a forward upper corner of the bolster opening 110 and riser 156 may be located proximate a rearward upper corner of the bolster opening 110. Further, a pair of lower bolster opening risers 158, 160 may be arranged on the first side wall 102, where riser 158 may be located proximate a forward lower corner of the bolster opening 110 and riser 160 may be located proximate a rearward lower corner of the bolster opening.

The location of the forward pedestal jaw risers 150, 152 may be defined from a dimension "R," which is defined as the distance from the lower spring seat surface 114 of the bolster opening 110 to the center to each of the pedestal jaw risers 150, 152. The center location of the pedestal jaw risers 150, 152 may further be defined by the dimension "0" which is defined as the distance from the lateral centerline 103 of the side frame 100.

The location of the upper corner bolster opening risers 154, 156 may be defined from a dimension "M," which is defined as the distance from the lower spring seat surface 114 of the bolster opening 110 to the center to each of the upper corner bolster opening risers 154, 156. The center location of the upper corner bolster opening risers 154, 156 may further be defined by the dimension "N" which is defined as the distance from the lateral centerline 103 of the side frame 100.

The location of the lower bolster opening risers 158, 160 may be defined from a dimension "S," which is defined as the distance from the lower spring seat surface 114 of the bolster opening 110 to the center to each of the lower bolster opening risers 158, 160. The center location of the lower bolster risers 158, 160 may further be defined by the dimension "U" which is defined as the distance from the lateral centerline 103 of the side frame 100.

Figure 6A:
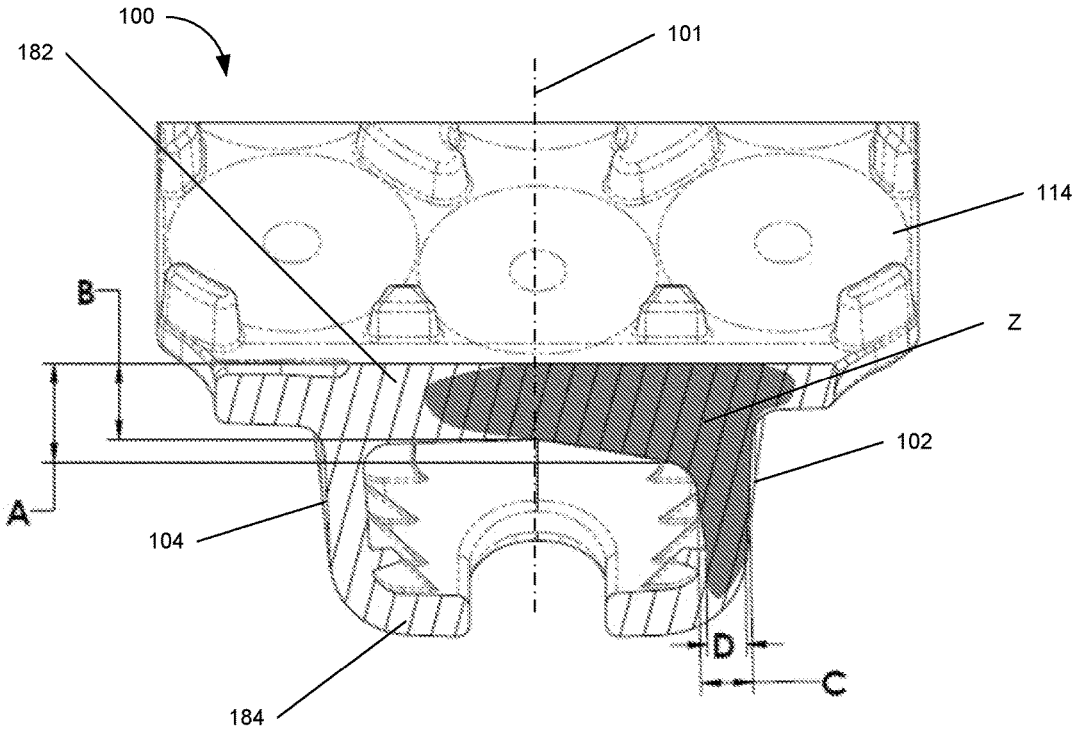
FIG. 6A illustrates a cross-section of the exemplary side frame of FIG. 5 along line 6A-6A.
Figure 6B:
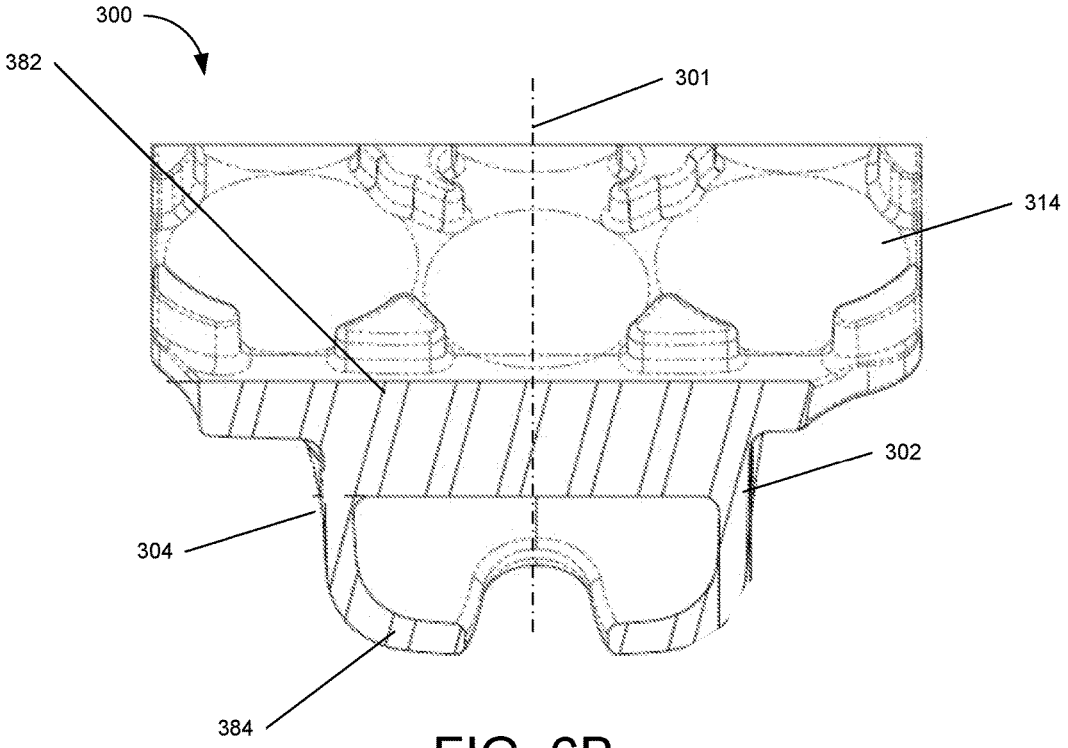
FIG. 6B illustrates a cross-section corresponding to the cross-section shown in FIG. 6A of a prior art side frame.

FIG. 6A illustrates a cross-sectional view of side frame 100 of FIG. 5, while FIG. 6B illustrates a similar cross-section of a prior art side frame 300. The cross-sections for both FIGS. 6A and 6B are both taken at similar locations of the side frame 100 as a cross-section taken through the forward lower corner of the bolster opening 110 at an angle "T" from the lower spring seat surface 114 of the bolster opening 110. The cross-section of FIG. 6A while taken proximate the forward lower corner of the bolster opening 110 is also representative of a cross-section at the same angle "T" taken at the same location proximate the rearward lower corner of the bolster opening 110. As such the wall thickness dimensions and description corresponding to FIG. 6A can be interpreted the same as if describing a cross-section taken proximate the rearward lower corner of the bolster opening 110.

The cross-section of FIG. 6A shows the bolster opening wall 182 proximate the forward lower corner of the bolster opening 110 may have a variable thickness. For example, the bolster opening wall 182 may have a thickness in cross-section FIG. 6A adjacent the first side wall 102 defined by dimension "A." The wall thickness of the bolster opening wall 182 may taper from the thickness "A" to a thickness "B" where the thickness "B" is located at approximately the lateral centerline 101 of the side frame 100. The thickness "B" may be the smallest thickness of the bolster opening wall 182. The bolster opening wall 182 thickness may also be expressed as a ratio of the thickness of the lower corner of the bolster opening 110 adjacent the first side wall 102, dimension "A," to the thickness of the lower bolster opening wall 182 proximate the lower corner of the bolster opening in a central portion of the lower bolster opening wall 182, dimension "B." The ratio of "A/B" may be within a range of about 1.05:1 and 1.73:1.

The cross-section FIG. 6A further shows the first side wall 102 may have a variable thickness. For example, the first side wall 102 may have a thickness adjacent the lower bolster opening wall 182 defined by the dimension "C." Additionally, the first side wall 102 thickness may taper in thickness as it approaches the bottom wall 184 of the side frame 100, where the first side wall 102 thickness proximate the corner of the bottom wall 184 of the side frame 100 may be defined by the dimension "D." The thickness "C" of the first side wall 102 proximate the lower corner bolster opening 110 may be greater than the thickness "D" of the first side wall 102 proximate the lower corner of the bolster opening 110 adjacent the bottom wall 184 of the side frame 100. Additionally, the thickness of the first side wall 102 proximate the risers 150, 152 may be greater than the thickness of the second side wall 104 opposite the first side wall 102. The first side wall 102 thickness between the lower bolster opening wall 182 and the bottom wall 184 of the side frame 100 may also be expressed as a ratio of the thickness of the first side wall 102 proximate the lower corner of the bolster opening 110 and adjacent the lower bolster opening wall 182, dimension "C," to thickness of the first side wall 102 proximate lower corner of the bolster opening 110 and adjacent the bottom wall 184 of the side frame 100, dimension "D." The ratio of "C/D" may be within a range of about 1.05:1 and 1.71:1.

The prior art side frame 300 illustrated in FIG. 6B, is described using reference numbers "3xx" to describe similar features of the embodiment described above using reference numbers "1xx". Thus, the reference numbers "3xx" may not be described fully or not at all. As shown in FIG. 6B, the lower bolster opening wall 382 has a substantially constant wall thickness between the first side wall 302 and second side wall 304. Additionally, the first side wall 302 has a substantially constant wall thickness between the lower bolster wall 382 and the bottom wall 384.

Figure 7A:
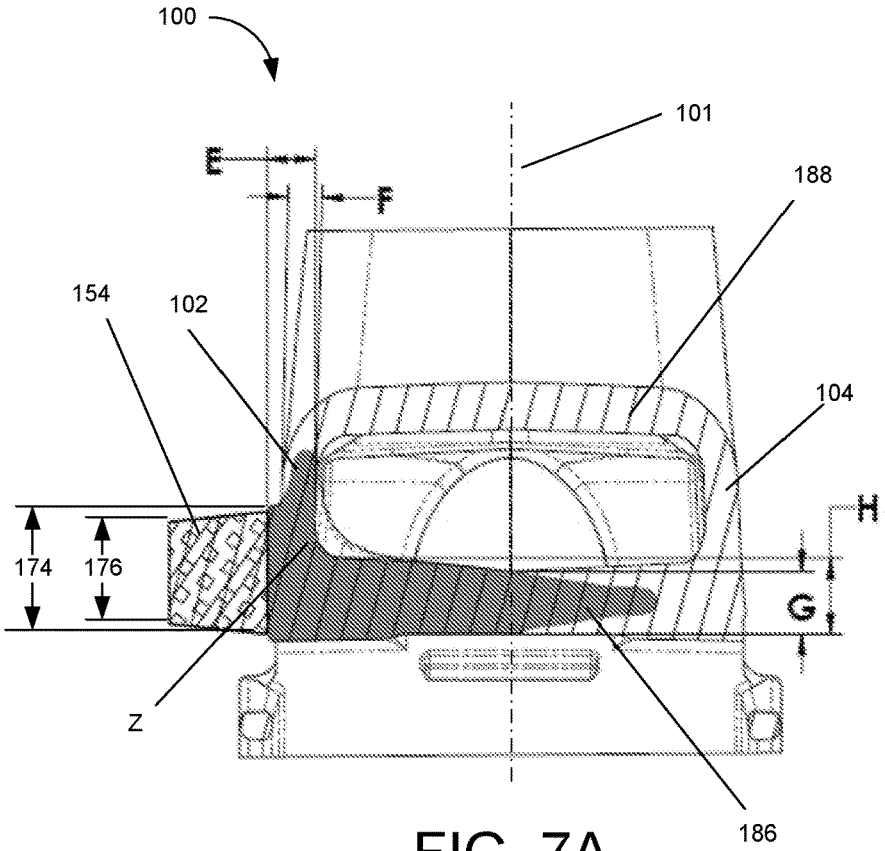
FIG. 7A illustrates a cross-section of the exemplary side frame of FIG. 5 at along line 7A-7A.
Figure 7B:
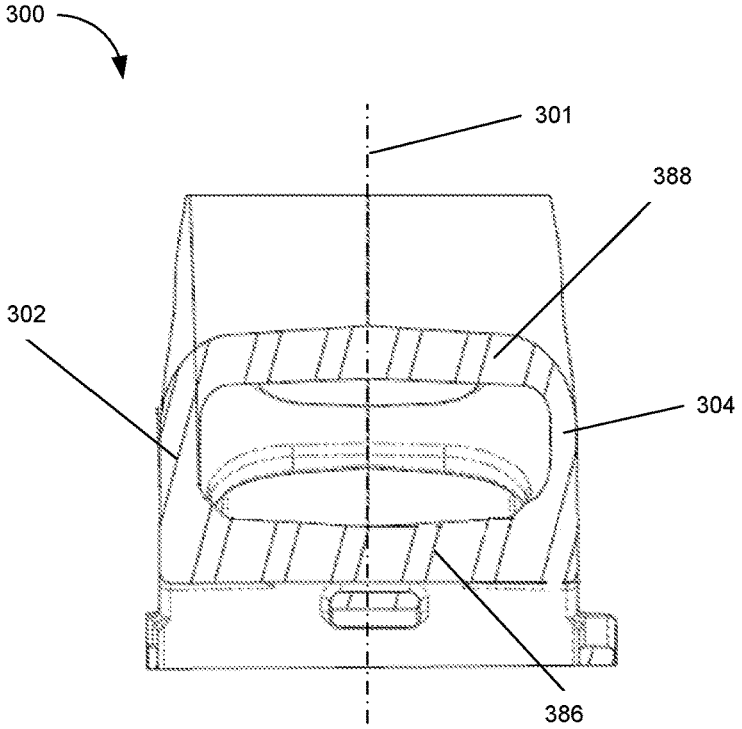
FIG. 7B illustrates a cross-section corresponding to the cross-section shown in FIG. 7A of a prior art side frame.

FIG. 7A illustrates a cross-sectional view of side frame 100 of FIG. 5, while FIG. 7B illustrates a similar cross-section of a prior art side frame 300. The cross-sections for both FIGS. 7A and 7B are both taken at similar locations of the side frame 100 as a cross-section taken through the forward upper corner bolster opening riser 154 at an angle "P" from the lateral centerline 101. The cross-section of FIG. 7A while taken proximate the forward upper corner of the bolster opening 110 through the riser 154 is also representative of a cross-section at the same angle "P" taken at the same location proximate the rearward upper corner of the bolster opening 110 through the rearward upper corner bolster opening riser 156. As such the wall thickness dimensions and description corresponding to FIG. 7A can be interpreted the same as if describing a cross-section taken proximate the rearward upper corner of the bolster opening 110 through riser 156.

The cross-section of FIG. 7A shows the bolster opening side wall 186 proximate the forward upper corner of the bolster opening 110 may have a variable thickness. For example, the bolster opening side wall 186 may have a thickness in cross-section FIG. 7A adjacent the first side wall 102 defined by dimension "H." The wall thickness may taper from the thickness "H" to a thickness "G" where the thickness "G" is located at approximately the lateral centerline 101 of the side frame 100. The thickness "G" may be the smallest thickness of the bolster opening side wall 186. In other words, the thickness "H" of at least a portion of the bolster opening side wall 186 adjacent the first side wall 102 may be greater than thickness "G" of the bolster opening wall in a central portion of the bolster opening wall 182. The thickness, "H," of the bolster opening side wall 186 proximate the upper corner of the bolster opening 110 adjacent the first side wall 102 may also be expressed as a ratio of the thickness, dimension "H," to the thickness of the bolster opening side wall 186 proximate the upper corner of the bolster opening in a central portion of the bolster opening wall 182, dimension "G." The ratio of "H/G" may be within a range of about 1.05:1 and 1.59:1.

The cross-section FIG. 7A further shows the first side wall 102 may have a variable thickness. For example, the first side wall 102 may have a thickness adjacent the bolster opening side wall 186 defined by the dimension "E." Additionally, the first side wall 102 thickness may taper in thickness as it approaches the top wall 188 of the side frame 100, where the thickness of the first side wall 102 proximate the corner of the top wall 188 of the side frame 100 may be defined by the dimension "F." The thickness "E" of the first side wall 102 proximate the upper corner of the bolster opening 110 may be greater than the thickness "F" of the first side wall 102 proximate the upper corner of the bolster opening 110 adjacent the top wall 188 of the side frame 100. In addition, the thickness of the first side wall 102 proximate the risers 154, 156 may be greater than the thickness of the second side wall 104 opposite the first side wall 102. The thickness of the first side wall 102 proximate the upper corner of bolster opening 110 and adjacent the bolster opening side wall 186 may also be expressed as a ratio of the thickness adjacent the bolster opening side wall 186, dimension "E," to the thickness of the first side wall 102 proximate the upper corner of the bolster opening and adjacent the top wall 188, dimension "F." The ratio of "E/F" may be within a range of about 1.55:1 and 2.73:1.

In addition, FIG. 7A, illustrates the riser 154 having a lower diameter 174 adjacent the first side wall 102 and an upper diameter 176 positioned at the opposite side of the riser 154.

The prior art side frame 300 illustrated in FIG. 7B, is described using reference numbers "3xx" to describe similar features of the embodiment described above using reference numbers "1xx". Thus, the reference numbers "3xx" may not be described fully or not at all. As shown in FIG. 7B, the bolster opening wall 386 has a substantially similar mirror image shape on either side of the center line 301. Additionally, each of the first side wall 302 and second side wall 302 has a substantially constant wall thickness between the upper bolster wall 386 and the top wall 388.

Figure 8A:
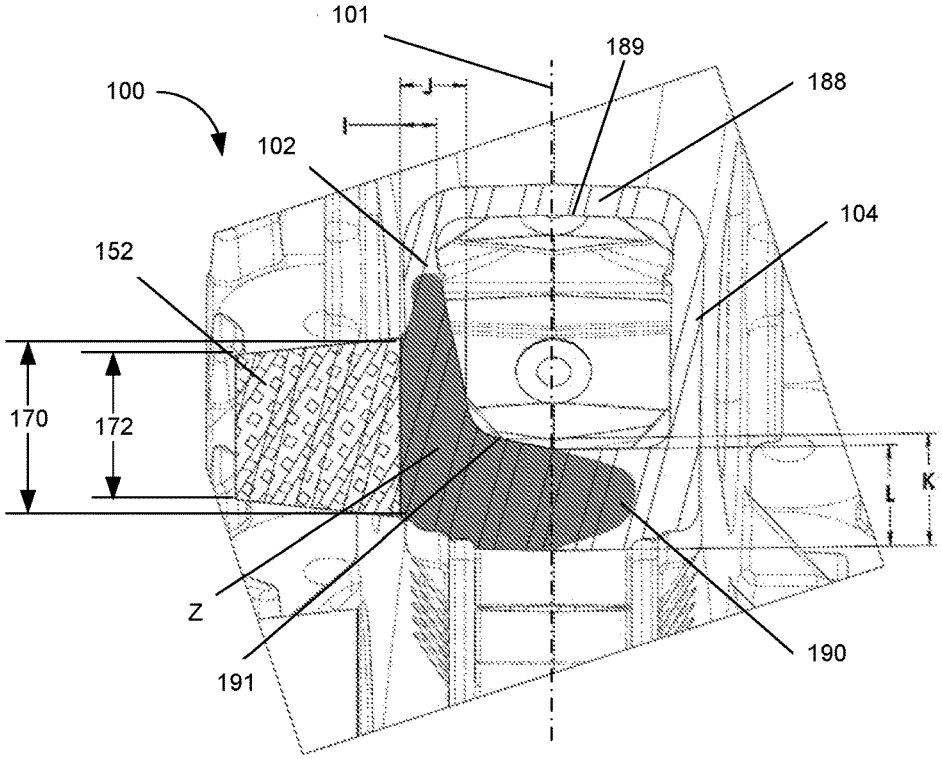
FIG. 8A illustrates a cross-section of the exemplary side frame of FIG. 5 at along line 8A-8A.
Figure 8B:
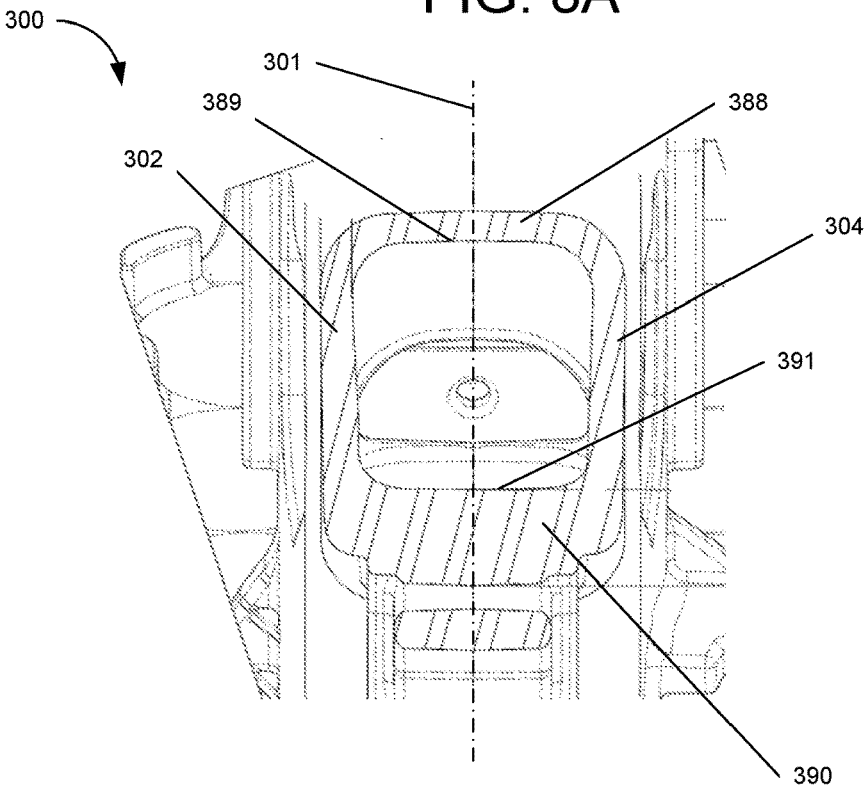
FIG. 8B illustrates a cross-section corresponding to the cross-section shown in FIG. 8A of a prior art side frame.

FIG. 8A illustrates a cross-sectional view of side frame 100 of FIG. 5, while FIG. 8B illustrates a similar cross-section of a prior art side frame 300. The cross-sections for both FIGS. 8A and 8B are both taken at similar locations of the side frame 100 as a cross-section taken through the rearward pedestal jaw riser 152 at an angle "Q" from the lower surface 145 of the column window 144. The cross-section of FIG. 8A while taken proximate the inboard corner of pedestal jaw 130 and through the rearward pedestal jaw riser 152 is also representative of a cross-section at the same angle "Q" taken at the same location proximate the inboard corner of pedestal jaw 120 and through the rearward pedestal jaw riser 150. As such the wall thickness dimensions and description corresponding to FIG. 8A can be interpreted the same as if describing a cross-section taken the inboard corner of pedestal jaw 120 and through the rearward pedestal jaw riser 150.

The cross-section of FIG. 8A shows the thickness of the pedestal jaw wall 190 proximate the inboard corner of the pedestal jaw 130 may have a variable thickness. For example, the pedestal jaw wall 190 may have a thickness in cross-section FIG. 8A adjacent the first side wall 102 defined by dimension "K." The wall thickness may taper from the thickness "K" to a thickness "L" where the thickness "L" is located at approximately the lateral centerline 101 of the side frame 100. In other words, the thickness "K" of at least a portion of the pedestal jaw wall 190 adjacent the first side wall 102 may be greater than thickness "L" of the bolster opening wall in a central portion of the pedestal jaw wall 190. As also show, the inner surface 191 adjacent the first side wall 102 of the pedestal jaw wall 190 converges in a direction toward the inner surface 189 of the top wall 188. The thickness "L" may be the smallest thickness of the pedestal jaw wall 190. The thickness, "K," of the pedestal jaw wall 190 proximate the inboard corner of the pedestal jaw adjacent the first side wall 102 may also be expressed as a ratio of the thickness adjacent the first side wall 102, dimension "K" to the thickness of the pedestal jaw wall 190 proximate the inboard corner of the pedestal jaw 190 in a central portion of the pedestal jaw wall, dimension "L." The ratio of "K/L" may be within a range of about 1.05:1 and 1.86:1.

The cross-section FIG. 8A further shows the first side wall 102 may have a variable thickness. For example, the first side wall 102 may have a thickness adjacent the pedestal jaw wall 190 defined by the dimension "J." Additionally, the thickness of the first side wall 102 may taper in as it approaches the top wall 188 of the side frame 100, where the first side wall 102 thickness proximate the corner of the top wall 188 of the side wall 102 may be defined by the dimension "I." The thickness "J" of the first side wall 102 proximate the inboard corner of the pedestal jaw 130 may be greater than the thickness "I" of the first side wall proximate the inboard corners of the pedestal jaw 130 adjacent the top wall 188 of the side frame 100. The thickness of the first side wall 102 proximate the risers 158, 160 may be greater than the thickness of the second side wall 104 opposite the first side wall 102. The thickness, "I," of the first side wall 102 proximate the inboard corner of the pedestal jaw 130 and adjacent the pedestal jaw wall 190 may also be expressed as a ratio of the thickness adjacent the pedestal jaw wall 190, dimension "I," to the thickness of the first side wall 102 proximate the inboard corner of the pedestal jaw 130 and adjacent a top wall 188, dimension "J." The ratio of "I/J" may be within a range of about 1.18:1 and 3.20:1.

In addition, FIG. 8A, illustrates the riser 152 having a lower diameter 170 adjacent the first side wall 102 and an upper diameter 172 positioned at the opposite side of the riser 152.

The prior art side frame 300 illustrated in FIG. 8B, is described using reference numbers "3xx" to describe similar features of the embodiment described above using reference numbers "1xx". Thus, the reference numbers "3xx" may not be described fully or not at all. As shown in FIG. 8B, the pedestal jaw wall 390 has an inner surface 391 that is substantially parallel to an inner surface 389 of the top wall 388 located between the first side wall 302 and second side wall 304. Additionally, the first side wall 302 and the second side wall 304 have a tapered wall thickness between the pedestal jaw wall 390 and the top wall 388; and as shown in FIG. 8B, the first side wall 302 and second side wall 304 are substantially mirror images of each other on opposite sides of the center line 302.

Since the railway car trucks may have different weight capacities, the side frame 100 may be designed with different dimensions to be specifically sized for a variety of truck capacities, such as a 70 ton capacity truck, a 110 ton capacity truck, and a 125 ton capacity truck. Example ranges for the dimensions described above for the side frame 100 in accordance with this disclosure are set forth in Table 1 below:

TABLE 1

Example Dimensional Ranges of Side Frame 100

| | 70 TON CAPACITY TRUCK | | 110 TON CAPACITY TRUCK DIMENSION | | 125 TON CAPACITY TRUCK | |
|---|---|---|---|---|---|---|
| | min. (inches) | max. (inches) | min. (inches) | max. (inches) | min. (inches) | max. (inches) |
| A | 1.70 | 2.20 | 2.01 | 2.51 | 2.22 | 2.72 |
| B | 1.05 | 1.55 | 1.80 | 2.30 | 1.76 | 2.26 |
| C | 0.88 | 1.38 | 1.30 | 1.80 | 1.02 | 1.52 |
| D | 0.53 | 1.03 | 1.03 | 1.53 | 0.61 | 1.11 |
| E | 0.96 | 1.46 | 0.79 | 1.29 | 0.74 | 1.24 |
| F | 0.26 | 0.76 | 0.32 | 0.82 | 0.25 | 0.75 |
| G | 0.39 | 0.89 | 0.95 | 1.45 | 1.17 | 1.67 |
| H | 0.48 | 0.98 | 1.13 | 1.63 | 1.71 | 2.21 |
| I | 0.77 | 1.27 | 0.36 | 0.86 | 0.47 | 0.97 |
| J | 1.18 | 1.68 | 1.44 | 1.94 | 1.43 | 1.93 |
| K | 1.75 | 2.25 | 1.89 | 2.39 | 2.54 | 3.04 |
| L | 1.32 | 1.82 | 1.75 | 2.25 | 1.47 | 1.97 |
| M | 15.57 | 18.57 | 16.78 | 19.78 | 16.88 | 19.88 |
| N | 8.75 | 11.75 | 9.75 | 12.75 | 9.44 | 12.44 |
| O | 26.50 | 29.50 | 27.57 | 30.57 | 27.75 | 30.75 |
| P | 35 DEG | 35 DEG | 35 DEG | 35 DEG | 35 DEG | 35 DEG |
| Q | 105 DEG | 105 DEG | 105 DEG | 105 DEG | 105 DEG | 105 DEG |
| R | 12.50 | 15.50 | 16.13 | 19.13 | 16.81 | 19.81 |
| S | −0.50 | 2.50 | −0.63 | 2.37 | 0.13 | 3.13 |
| T | 45 DEG | 45 DEG | 45 DEG | 45 DEG | 45 DEG | 45 DEG |
| U | 12.38 | 15.38 | 11.88 | 14.88 | 12.50 | 15.50 |
| Ratio of A/B:1 | 1.28 | 1.73 | 1.05 | 1.26 | 1.04 | 1.41 |
| Ratio of C/D:1 | 1.22 | 1.65 | 1.05 | 1.39 | 1.26 | 1.71 |
| Ratio of E/F:1 | 2.01 | 2.73 | 1.55 | 2.10 | 1.68 | 2.28 |
| Ratio of H/G:1 | 1.05 | 1.33 | 1.05 | 1.33 | 1.18 | 1.59 |
| Ratio of J/I:1 | 1.18 | 1.60 | 2.37 | 3.20 | 1.97 | 2.67 |
| Ratio of K/L:1 | 1.08 | 1.47 | 1.05 | 1.23 | 1.38 | 1.86 |

Table 1 above describes some general ranges of dimensions that may be used and characteristics that may be exhibited by some specific examples of the side frame 100 and in accordance with this disclosure. A side frame 100 need not have dimensions and characteristics that fall within all of the ranges identified for each capacity type in Table 1 to fall within the scope of this disclosure.

Table 2 below provides additional, more particular ranges of dimensions, at least some of which may be exhibited by at least some example side frames 100 in accordance with this disclosure:

TABLE 2

Example Dimensional Ranges of Side Frame 100

| | 70 TON CAPACITY TRUCK | | 110 TON CAPACITY TRUCK DIMENSION | | 125 TON CAPACITY TRUCK | |
|---|---|---|---|---|---|---|
| | min. (inches) | max. (inches) | min. (inches) | max. (inches) | min. (inches) | max. (inches) |
| A | 1.83 | 2.08 | 2.13 | 2.38 | 2.35 | 2.60 |
| B | 1.17 | 1.42 | 1.93 | 2.18 | 1.89 | 2.14 |
| C | 1.00 | 1.25 | 1.42 | 1.67 | 1.15 | 1.40 |
| D | 0.66 | 0.91 | 1.15 | 1.40 | 0.73 | 0.98 |
| E | 1.09 | 1.34 | 0.91 | 1.16 | 0.87 | 1.12 |
| F | 0.39 | 0.64 | 0.44 | 0.69 | 0.38 | 0.63 |
| G | 0.51 | 0.76 | 1.07 | 1.32 | 1.29 | 1.54 |
| H | 0.61 | 0.86 | 1.26 | 1.51 | 1.84 | 2.09 |
| I | 0.90 | 1.15 | 0.48 | 0.73 | 0.60 | 0.85 |
| J | 1.30 | 1.55 | 1.57 | 1.82 | 1.55 | 1.80 |
| K | 1.88 | 2.13 | 2.02 | 2.27 | 2.66 | 2.91 |
| L | 1.45 | 1.70 | 1.87 | 2.12 | 1.59 | 1.84 |
| M | 16.32 | 17.82 | 17.53 | 19.03 | 17.63 | 19.13 |
| N | 9.50 | 11.00 | 10.50 | 12.00 | 10.19 | 11.69 |
| O | 27.25 | 28.75 | 28.32 | 29.82 | 28.50 | 30.00 |
| P | 35 DEG | 35 DEG | 35 DEG | 35 DEG | 35 DEG | 35 DEG |
| Q | 105 DEG | 105 DEG | 105 DEG | 105 DEG | 105 DEG | 105 DEG |
| R | 13.25 | 14.75 | 16.88 | 18.38 | 17.56 | 19.06 |
| S | 0.25 | 1.75 | 0.12 | 1.62 | 0.88 | 2.38 |
| T | 45 DEG | 45 DEG | 45 DEG | 45 DEG | 45 DEG | 45 DEG |
| U | 13.13 | 14.63 | 12.63 | 14.13 | 13.25 | 14.75 |
| Ratio of A/B:1 | 1.32 | 1.66 | 1.05 | 1.22 | 1.08 | 1.36 |
| Ratio of C/D:1 | 1.27 | 1.59 | 1.07 | 1.34 | 1.31 | 1.64 |
| Ratio of E/F:1 | 2.09 | 2.62 | 1.61 | 2.02 | 1.75 | 2.19 |
| Ratio of H/G:1 | 1.05 | 1.28 | 1.05 | 1.28 | 1.22 | 1.53 |
| Ratio of J/I:1 | 1.23 | 1.54 | 2.46 | 3.08 | 2.04 | 2.57 |
| Ratio of K/L:1 | 1.12 | 1.41 | 1.05 | 1.19 | 1.43 | 1.79 |

The various ranges provided in Table 2 are simply examples. A side frame 100 need not have dimensions or characteristics that satisfy all of these identified ranges to fall within the scope of this disclosure.

Table 3 provides even more targeted dimensions and characteristics of a side frame 100 in accordance with a specific example of this disclosure. Of course, a side frame 100 need not have these specific dimensions and/or characteristics to fall within the scope of this disclosure.

TABLE 3

Example Dimensional Ranges of Side Frame 100

| | 70 TON CAPACITY | 110 TON CAPACITY DIMENSIONS | 125 TON CAPACITY |
|---|---|---|---|
| | (inches) | (inches) | (inches) |
| A | 1.95 | 2.26 | 2.47 |
| B | 1.30 | 2.05 | 2.01 |
| C | 1.13 | 1.55 | 1.27 |

TABLE 3-continued

Example Dimensional Ranges of Side Frame 100

| | 70 TON CAPACITY | 110 TON CAPACITY DIMENSIONS | 125 TON CAPACITY |
|---|---|---|---|
| | (inches) | (inches) | (inches) |
| D | 0.78 | 1.28 | 0.86 |
| E | 1.21 | 1.04 | 0.99 |

TABLE 3-continued

Example Dimensional Ranges of Side Frame 100

| | 70 TON CAPACITY | 110 TON CAPACITY DIMENSIONS | 125 TON CAPACITY |
|---|---|---|---|
| | (inches) | (inches) | (inches) |
| F | 0.51 | 0.57 | 0.50 |
| G | 0.64 | 1.20 | 1.42 |
| H | 0.73 | 1.38 | 1.96 |
| I | 1.02 | 0.61 | 0.72 |
| J | 1.43 | 1.69 | 1.68 |
| K | 2.00 | 2.14 | 2.79 |
| L | 1.57 | 2.00 | 1.72 |
| M | 17.07 | 18.28 | 18.38 |
| N | 10.25 | 11.25 | 10.94 |
| O | 28.00 | 29.07 | 29.25 |
| P | 35 DEG | 35 DEG | 35 DEG |
| Q | 105 DEG | 105 DEG | 105 DEG |
| R | 14.00 | 17.63 | 18.31 |
| S | 1.00 | 0.87 | 1.63 |
| T | 45 DEG | 45 DEG | 45 DEG |

TABLE 3-continued

| Example Dimensional Ranges of Side Frame 100 | | | |
|---|---|---|---|
| | 70 TON CAPACITY | 110 TON CAPACITY | 125 TON CAPACITY |
| | DIMENSIONS | | |
| | (inches) | (inches) | (inches) |
| U | 13.88 | 13.38 | 14.00 |
| Ratio of A/B:1 | 1.50 | 1.10 | 1.23 |
| Ratio of C/D:1 | 1.44 | 1.21 | 1.48 |
| Ratio of E/F:1 | 2.37 | 1.83 | 1.98 |
| Ratio of H/G:1 | 1.15 | 1.15 | 1.38 |
| Ratio of J/I:1 | 1.39 | 2.79 | 2.32 |
| Ratio of K/L:1 | 1.27 | 1.07 | 1.62 |

While specific dimensions, characteristics, and/or ranges of dimensions and characteristics are set forth in the various tables above, those skilled in the art will recognize that these dimensions and ranges are examples that may be used in at least some examples of this disclosure. Many variations in the ranges and the specific dimensions and characteristics may be used without departing from this disclosure.

While various embodiments have been described, it will be apparent to those of ordinary skill in the art that many more embodiments and implementations are possible that are within the scope of the claims. The various dimensions described above are merely exemplary and may be changed as necessary. Accordingly, it will be apparent to those of ordinary skill in the art that many more embodiments and implementations are possible that are within the scope of the claims. Therefore, the embodiments described are only provided to aid in understanding the claims and do not limit the scope of the claims.

What is claimed is:

1. A side frame for a railway car truck, the side frame comprising:

a forward pedestal jaw and a rearward pedestal jaw, the forward and rearward pedestal jaws configured for mounting wheel assemblies, the side frame having a center disposed substantially equally between the forward pedestal jaw and the rearward pedestal jaw;

a first side wall and a second side wall;

a bolster opening having an upper bolster opening surface, a lower spring seat surface, a forward surface, and a rearward surface;

a first riser arranged on the first side wall proximate to a forward lower corner of the bolster opening;

a second riser arranged on the first side wall proximate to a rearward lower corner of the bolster opening;

a third riser arranged on the first side wall proximate to a forward upper corner of the bolster opening;

a fourth riser arranged on the first side wall proximate to a rearward upper corner of the bolster opening;

a fifth riser arranged on the first side wall proximate to an upper inboard corner of a forward pedestal jaw; and a sixth riser arranged on the first side wall proximate to an upper inboard corner of a rearward pedestal jaw;

wherein a thickness of the first side wall is greater than a thickness of the second side wall proximate each of the first riser, the second riser, the third riser, the fourth riser, the fifth riser, and the sixth riser, and wherein a thickness of at least a portion of the bolster opening wall is greater adjacent the first side wall than the thickness of the bolster opening wall in an opposite portion of the bolster opening wall adjacent the second side wall facing the first sidewall; and wherein the thickness of the bolster opening wall adjacent the first side wall tapers from the first side wall to a central point of the bolster opening wall.

2. The side frame of claim 1, wherein a center of the first riser is arranged between about 12.38 inches and 15.38 inches forward of the center and between about −0.5 inches and 2.5 inches above the lower spring seat surface of the bolster opening;

wherein a center of the second riser is arranged between about 12.38 inches and 15.38 inches rearward of the center and between about −0.5 inches and 2.5 inches above the lower spring seat surface of the bolster opening;

wherein a center of the third riser is arranged between about 8.75 inches and 11.75 inches forward of the center and between about 15.57 inches and 18.57 inches above the lower spring seat surface of the bolster opening;

wherein a center of the fourth riser is arranged between about 8.75 inches and 11.75 inches rearward of the center and between about 15.57 inches and 18.57 inches above the lower spring seat surface of the bolster opening;

wherein a center of the fifth riser is arranged between about 26.50 inches and 29.50 inches forward of the center and between about 12.50 inches and 15.50 inches above the lower spring seat surface of the bolster opening; and wherein a center of the sixth riser is arranged between about 26.50 inches and 29.50 inches rearward of the center and between about 12.50 inches and 15.50 inches above the lower spring seat surface of the bolster opening.

3. The side frame for a railway car truck of claim 1, wherein a center of the first riser is arranged between about 11.88 inches and 14.88 inches forward of the center and between about −0.63 inches and 2.37 inches above the lower spring seat surface of the bolster opening;

wherein a center of the second riser is arranged between about 11.88 inches and 14.88 inches rearward of the center and between about −0.63 inches and 2.37 inches above the lower spring seat surface of the bolster opening;

wherein a center of the third riser is arranged between about 9.75 inches and 12.75 inches forward of the center and between about 16.78 inches and 19.78 inches above the lower spring seat surface of the bolster opening;

wherein a center of the fourth riser is arranged between about 9.75 inches and 12.75 inches rearward of the center and between about 16.78 inches and 19.78 inches above the lower spring seat surface of the bolster opening;

wherein a center of the fifth riser is arranged between about 27.57 inches and 30.57 inches forward of the center and between about 16.13 inches and 19.13 inches above the lower spring seat surface of the bolster opening; and wherein a center of the sixth riser is arranged between about 27.57 inches and 30.57 inches rearward of the center and between about 16.13 inches and 19.13 inches above the lower spring seat surface of the bolster opening.

4. The side frame for a railway car truck of claim 1, wherein a center of the first riser is arranged between about 12.50 inches and 15.50 inches forward of the center and between about 0.13 inches and 3.13 inches above the lower spring seat surface of the bolster opening;

wherein a center of the second riser is arranged between about 12.50 inches and 15.50 inches rearward of the center and between about 0.13 inches and 3.13 inches above the lower spring seat surface of the bolster opening;

wherein a center of the third riser is arranged between about 9.44 inches and 12.44 inches forward of the center and between about 16.88 inches and 19.88 inches above the lower spring seat surface of the bolster opening;

wherein a center of the fourth riser is arranged between about 9.44 inches and 12.44 inches rearward of the center and between about 16.88 inches and 19.88 inches above the lower spring seat surface of the bolster opening;

wherein a center of the fifth riser is arranged between about 27.75 inches and 30.75 inches forward of the center and between about 16.81 inches and 19.81 inches above the lower spring seat surface of the bolster opening; and wherein a center of the sixth riser is arranged between about 27.75 inches and 30.75 inches rearward of the center and between about 16.81 inches and 19.81 inches above the lower spring seat surface of the bolster opening.

5. A side frame for a railway car truck, the side frame comprising:

a forward pedestal jaw and a rearward pedestal jaw, the forward and rearward jaws configured for mounting wheel assemblies, the side frame having a center disposed substantially equally between the forward pedestal jaw and the rearward pedestal jaw;

a first side wall and a second side wall;

a bolster opening having an upper bolster opening surface, a lower spring seat surface, a forward surface, and a rearward surface;

a plurality of risers arranged on the first side wall;

a bolster opening wall defining the bolster opening and forming the upper bolster opening surface, the lower spring seat surface, the forward surface of the bolster opening, and the rearward surface of the bolster opening, wherein a thickness of at least a portion of the bolster opening wall is greater adjacent the first side wall than the thickness of the bolster opening wall in a central portion of the bolster opening wall;

wherein a thickness of the first side wall is greater than a thickness of the second side wall proximate each of the plurality of risers;

wherein a thickness of at least a portion of the bolster opening wall is greater adjacent the first side wall than the thickness of the bolster opening wall in an opposite portion of the bolster opening wall adjacent the second side wall facing the first sidewall; and wherein the thickness of the bolster opening wall adjacent the first side wall tapers from the first side wall to a central point of the bolster opening wall.

6. The side frame for a railway car truck of claim 5, wherein the thickness of the bolster opening wall proximate a forward lower corner of the bolster opening adjacent the first side wall is between about 1.70 inches and 2.20 inches;

wherein the thickness of the bolster opening wall proximate a rearward lower corner of the bolster opening adjacent the first side wall is between about 1.70 inches and 2.20 inches;

wherein the thickness of the bolster opening wall proximate the forward lower corner of the bolster opening in the central portion of the bolster opening wall is between about 1.05 inches and 1.55 inches; and wherein the thickness of the bolster opening wall proximate the rearward lower corner of the bolster opening in the central portion of the bolster opening wall is between about 1.05 inches and 1.55 inches.

7. The side frame for a railway car truck of claim 5, wherein the thickness of the bolster opening wall proximate a forward lower corner of the bolster opening adjacent the first side wall is between about 2.01 inches and 2.51 inches;

wherein the thickness of the bolster opening wall proximate a rearward lower corner of the bolster opening adjacent the first side wall is between about 2.01 inches and 2.51 inches;

wherein the thickness of the bolster opening wall proximate the forward lower corner of the bolster opening in the central portion of the bolster opening wall is between about 1.80 inches and 2.30 inches; and wherein the thickness of the bolster opening wall proximate the rearward lower corner of the bolster opening in the central portion of the bolster opening wall is between about 1.80 inches and 2.30 inches.

8. The side frame for a railway car truck of claim 5, wherein the thickness of the bolster opening wall proximate a forward lower corner of the bolster opening adjacent the first side wall is between about 2.22 inches and 2.72 inches;

wherein the thickness of the bolster opening wall proximate a rearward lower corner of the bolster opening adjacent the first side wall is between about 2.22 inches and 2.72 inches;

wherein the thickness of the bolster opening wall proximate the forward lower corner of the bolster opening in the central portion of the bolster opening wall is between about 1.76 inches and 2.26 inches; and wherein the thickness of the bolster opening wall proximate the rearward lower corner of the bolster opening in the central portion of the bolster opening wall is between about 1.76 inches and 2.26 inches.

9. The side frame for a railway car truck of claim 5, wherein a thickness of the first side wall proximate a forward lower corner of the bolster opening is greater than the thickness of the first side wall proximate the forward lower corner of the bolster opening and adjacent a bottom wall of the side frame; and wherein a thickness of the first side wall proximate a rearward lower corner of the bolster opening is greater than the thickness of the first side wall proximate the rearward lower corner of the bolster opening and adjacent the bottom wall of the side frame.

10. The side frame for a railway car truck of claim 9, wherein the thickness of the first side wall proximate the forward lower corner of the bolster opening and adjacent the bolster opening wall is between about 0.88 inches and 1.38 inches;

wherein the thickness of the first side wall proximate the rearward lower corner of the bolster opening and adjacent the bolster opening wall is between about 0.88 inches and 1.38 inches;

wherein the thickness of the first side wall proximate the forward lower corner of the bolster opening and adjacent the bottom wall of the side frame is between about 0.53 inches and 1.03 inches; and wherein the thickness of the first side wall proximate the rearward lower corner of the bolster opening and adjacent the bottom wall of the side frame is between about 0.53 inches and 1.03 inches.

11. The side frame for a railway car truck of claim 9, wherein the thickness of the first side wall proximate the forward lower corner of the bolster opening and adjacent the bolster opening wall is between about 1.30 inches and 1.80 inches;

wherein the thickness of the first side wall proximate the rearward lower corner of the bolster opening and adjacent the bolster opening wall is between about 1.30 inches and 1.80 inches;

wherein the thickness of the first side wall proximate the forward lower corner of the bolster opening and adjacent the bottom wall of the side frame is between about 1.03 inches and 1.53 inches; and wherein the thickness of the first side wall proximate the rearward lower corner of the bolster opening and adjacent the bottom wall of the side frame is between about 1.03 inches and 1.53 inches.

12. The side frame for a railway car truck of claim 9, wherein the thickness of the first side wall proximate the forward lower corner of the bolster opening and adjacent the bolster opening wall is between about 1.02 inches and 1.52 inches;

wherein the thickness of the first side wall proximate the rearward lower corner of the bolster opening and adjacent the bolster opening wall is between about 1.02 inches and 1.52 inches;

wherein the thickness of the first side wall proximate the forward lower corner of the bolster opening and adjacent the bottom wall of the side frame is between about 0.61 inches and 1.11 inches; and wherein the thickness of the first side wall proximate the rearward lower corner of the bolster opening and adjacent the bottom wall of the side frame is between about 0.61 inches and 1.11 inches.

13. The side frame for a railway car truck of claim 5, wherein the thickness of the bolster opening wall proximate a forward upper corner of the bolster opening adjacent the first side wall is between about 0.48 inches and 0.98 inches;

wherein the thickness of the bolster opening wall proximate a rearward upper corner of the bolster opening adjacent the first side wall is between about 0.48 inches and 0.98 inches;

wherein the thickness of the bolster opening wall proximate the forward upper corner of the bolster opening in the central portion of the bolster opening wall is between about 0.39 inches and 0.89 inches; and wherein the thickness of the bolster opening wall proximate the rearward upper corner of the bolster opening in the central portion of the bolster opening wall is between about 0.39 inches and 0.89 inches.

14. The side frame for a railway car truck of claim 5, wherein the thickness of the bolster opening wall proximate a forward upper corner of the bolster opening adjacent the first side wall is between about 1.13 inches and 1.63 inches;

wherein the thickness of the bolster opening wall proximate a rearward upper corner of the bolster opening adjacent the first side wall is between about 1.13 inches and 1.63 inches;

wherein the thickness of the bolster opening wall proximate the forward upper corner of the bolster opening in the central portion of the bolster opening wall is between about 0.95 inches and 1.45 inches; and wherein the thickness of the bolster opening wall proximate the rearward upper corner of the bolster opening in the central portion of the bolster opening wall is between about 0.95 inches and 1.45 inches.

15. The side frame for a railway car truck of claim 5, wherein the thickness of the bolster opening wall proximate a forward upper corner of the bolster opening adjacent the first side wall is between about 1.71 inches and 2.21 inches;

wherein the thickness of the bolster opening wall proximate a rearward upper corner of the bolster opening adjacent the first side wall is between about 1.71 inches and 2.21 inches;

wherein the thickness of the bolster opening wall proximate the forward upper corner of the bolster opening in the central portion of the bolster opening wall is between about 1.17 inches and 1.67 inches; and wherein the thickness of the bolster opening wall proximate the rearward upper corner of the bolster opening in the central portion of the bolster opening wall is between about 1.17 inches and 1.67 inches.

16. The side frame for a railway car truck of claim 5, wherein a thickness of the first side wall proximate a forward upper corner of the bolster opening is greater than the thickness of the first side wall proximate the forward upper corner of the bolster opening and adjacent a top wall of the side frame; and wherein a thickness of the first side wall proximate a rearward upper corner of the bolster opening is greater than the thickness of the first side wall proximate the rearward upper corner of the bolster opening and adjacent the top wall of the side frame.

17. The side frame for a railway car truck of claim 16, wherein the thickness of the first side wall proximate the forward upper corner of the bolster opening and adjacent the bolster opening side wall is between about 0.96 inches and 1.46 inches;

wherein the thickness of the first side wall proximate the rearward upper corner of the bolster opening and adjacent the bolster opening side wall is between about 0.96 inches and 1.46 inches;

wherein the thickness of the first side wall proximate the forward upper corner of the bolster opening and adjacent the top wall of the side frame is between about 0.26 inches and 0.76 inches; and wherein the thickness of the first side wall proximate the rearward upper corner of the bolster opening and adjacent the top wall of the side frame is between about 0.26 inches and 0.76 inches.

18. The side frame for a railway car truck of claim 16, wherein the thickness of the first side wall proximate the forward upper corner of the bolster opening and adjacent the bolster opening side wall is between about 0.79 inches and 1.29 inches;

wherein the thickness of the first side wall proximate the rearward upper corner of the bolster opening and adjacent the bolster opening side wall is between about 0.79 inches and 1.29 inches;

wherein the thickness of the first side wall proximate the forward upper corner of the bolster opening and adjacent the top wall of the side frame is between about 0.32 inches and 0.82 inches; and wherein the thickness of the first side wall proximate the rearward upper corner of the bolster opening and adjacent the top wall of the side frame is between about 0.32 inches and 0.82 inches.

19. The side frame for a railway car truck of claim 16, wherein the thickness of the first side wall proximate the forward upper corner of the bolster opening and adjacent the bolster opening side wall is between about 0.74 inches and 1.24 inches;

wherein the thickness of the first side wall proximate the rearward upper corner of the bolster opening and adjacent the bolster opening side wall is between about 0.74 inches and 1.24 inches;

wherein the thickness of the first side wall proximate the forward upper corner of the bolster opening and adjacent the top wall of the side frame is between about 0.25 inches and 0.75 inches; and wherein the thickness of the first side wall proximate the rearward upper corner of the bolster opening and adjacent the top wall of the side frame is between about 0.25 inches and 0.75 inches.

20. The side frame for a railway car truck of claim 5, further comprising a forward pedestal jaw wall and a rearward pedestal jaw wall defining the respective forward and rearward pedestal jaws, wherein a thickness of at least a portion of the forward pedestal jaw wall is greater adjacent the first side wall than the thickness of the forward pedestal jaw wall adjacent the second side wall; and wherein a thickness of at least a portion of the rearward pedestal jaw wall is greater adjacent the first side wall than the thickness of the rearward pedestal jaw wall adjacent the second side wall.

21. The side frame for a railway car truck of claim 20, wherein the thickness of the forward pedestal jaw wall proximate an upper inboard corner of the forward pedestal jaw adjacent the first side wall is between about 1.75 inches and 2.25 inches;

wherein the thickness of the rearward pedestal jaw wall proximate an upper inboard corner of the rearward pedestal jaw adjacent the first side wall is between about 1.75 inches and 2.25 inches; and wherein the thickness of the forward pedestal jaw wall proximate the upper inboard corner of the forward pedestal jaw in a central portion of the forward pedestal jaw wall is between about 1.32 inches and 1.82 inches; and wherein the thickness of the rearward pedestal jaw wall proximate the upper inboard corner of the rearward pedestal jaw in the central portion of the rearward pedestal jaw wall is between about 1.32 inches and 1.82 inches.

22. The side frame for a railway car truck of claim 20, wherein the thickness of the forward pedestal jaw wall proximate an upper inboard corner of the forward pedestal jaw adjacent the first side wall is between about 1.89 inches and 2.39 inches;

wherein the thickness of the rearward pedestal jaw wall proximate an upper inboard corner of the rearward pedestal jaw adjacent the first side wall is between about 1.89 inches and 2.39 inches;

wherein the thickness of the forward pedestal jaw wall proximate the upper inboard corner of the forward pedestal jaw in a central portion of the forward pedestal jaw wall is between about 1.75 inches and 2.25 inches; and wherein the thickness of the rearward pedestal jaw wall proximate the upper inboard corner of the rearward pedestal jaw in the central portion of the rearward pedestal jaw wall is between about 1.75 inches and 2.25 inches.

23. The side frame for a railway car truck of claim 20, wherein the thickness of the forward pedestal jaw wall proximate an upper inboard corner of the forward pedestal jaw adjacent the first side wall is between about 2.54 inches and 3.04 inches;

wherein the thickness of the rearward pedestal jaw wall proximate an upper inboard corner of an upper inboard corner of the rearward pedestal jaw adjacent the first side wall is between about 2.54 inches and 3.04 inches;

wherein the thickness of the forward pedestal jaw wall proximate the upper inboard corner of the forward pedestal jaw in a central portion of the forward pedestal jaw wall is between about 1.47 inches and 1.97 inches; and wherein the thickness of the rearward pedestal jaw wall proximate the upper inboard corner of the rearward pedestal jaw in a central portion of the rearward pedestal jaw wall is between about 1.47 inches and 1.97 inches.

24. The side frame for a railway car truck of claim 5, wherein a thickness of the first side wall proximate an upper inboard corner of the forward pedestal jaw is greater than the thickness of the first side wall proximate the upper inboard corner of the forward pedestal jaw and adjacent a top wall of the side frame; and wherein a thickness of the first side wall proximate an upper inboard corner of the rearward pedestal jaw is greater than the thickness of the first side wall proximate the upper inboard corner of the rearward pedestal jaw and adjacent the top wall of the side frame.

25. The side frame for a railway car truck of claim 24, wherein the thickness of the first side wall proximate the upper inboard corner of the forward pedestal jaw and adjacent a forward pedestal jaw wall is between about 1.18 inches and 1.68 inches;

wherein the thickness of the first side wall proximate the upper inboard corner of the rearward pedestal jaw and a rearward pedestal jaw wall is between about 1.18 inches and 1.68 inches; and wherein the thickness of the first side wall proximate the upper inboard corner of the forward pedestal jaw and adjacent the top wall of the side frame is between about 0.77 inches and 1.27 inches; and wherein the thickness of the first side wall proximate the upper inboard corner of the rearward pedestal jaw and adjacent the top wall of the side frame is between about 0.77 inches and 1.27 inches.

26. The side frame for a railway car truck of claim 24, wherein the thickness of the first side wall proximate the upper inboard corner of the forward pedestal jaw and adjacent a forward pedestal jaw wall is between about 1.44 inches and 1.94 inches;

wherein the thickness of the first side wall proximate the upper inboard corner of the rearward pedestal jaw and adjacent a rearward pedestal jaw wall is between about 1.44 inches and 1.94 inches; and wherein the thickness of the first side wall proximate the upper inboard corner of the forward pedestal jaw and adjacent the top wall of the side frame is between about 0.36 inches and 0.86 inch; and wherein the thickness of the first side wall proximate the upper inboard corner of the rearward pedestal jaw and adjacent the top wall of the side frame is between about 0.36 inches and 0.86 inches.

27. The side frame for a railway car truck of claim 24, wherein the thickness of the first side wall proximate the upper inboard corner of the forward pedestal jaw and adjacent a forward pedestal jaw wall is between about 1.43 inches and 1.93 inches;

wherein the thickness of the first side wall proximate the upper inboard corner of the rearward pedestal jaw and adjacent a rearward pedestal jaw wall is between about 1.43 inches and 1.93 inches; and wherein the thickness of the first side wall proximate the upper inboard corner of the forward pedestal jaw and adjacent the top wall of the side frame is between about 0.47 inches and 0.97 inches; and wherein the thickness of the first side wall proximate the upper inboard corner of the rearward pedestal jaw and adjacent the top wall of the side frame is between about 0.47 inches and 0.97 inches.

28. A side frame for a railway car truck, the side frame comprising:

a forward pedestal jaw and a rearward pedestal jaw, the forward and rearward pedestal jaws configured for mounting wheel assemblies, the side frame having a center disposed substantially equally between the forward pedestal jaw and the rearward pedestal jaw;

a forward pedestal jaw wall and a rearward pedestal jaw wall defining the respective forward and rearward pedestal jaws;

a first side wall and a second side wall;

a bolster opening having an upper bolster opening surface, a lower spring seat surface, a forward surface, and a rearward surface;

a bolster opening wall defining the bolster opening and forming the upper bolster opening surface, the lower spring seat surface, the forward surface of the bolster opening, and the rearward surface of the bolster opening, a plurality of risers arranged on the first side wall;

wherein a thickness of the first side wall is greater than a thickness of the second side wall proximate each of the plurality of risers;

wherein a thickness of at least a portion of the bolster opening wall is greater adjacent the first side wall than the thickness of the bolster opening wall in a central portion of the bolster opening wall;

wherein a thickness of at least a portion of the forward pedestal jaw wall is greater adjacent the first side wall than the thickness of the forward pedestal jaw wall adjacent the second side wall; and wherein a thickness of at least a portion of the bolster opening wall is greater adjacent the first side wall than the thickness of the bolster opening wall in an opposite portion of the bolster opening wall adjacent the second side wall facing the first sidewall; and wherein the thickness of the bolster opening wall adjacent the first side wall tapers from the first side wall to a central point of the bolster opening wall.

29. The side frame for a railway car truck of claim 28, wherein a ratio of the thickness of the bolster opening wall proximate the forward lower corner of the bolster opening adjacent the first side wall to the thickness of the bolster opening wall proximate the forward lower corner of the bolster opening in a central portion of the bolster opening wall is between about 1.05:1 and 1.73:1; and wherein a ratio of the thickness of the bolster opening wall proximate the rearward lower corner of the bolster opening adjacent the first side wall to the thickness of the bolster opening wall proximate the rearward lower corner of the bolster opening in the central portion of the bolster opening wall is between about 1.05:1 and 1.73:1.

30. The side frame for a railway car truck of claim 28, wherein a ratio of the thickness of the first side wall proximate the forward lower corner of the bolster opening and adjacent the bolster opening wall to the thickness of the first side wall proximate the forward lower corner of the bolster opening and adjacent a bottom wall of the side frame is between about 1.05:1 and 1.71:1; and wherein a ratio of the thickness of the first side wall proximate the rearward lower corner of the bolster opening and adjacent the bolster opening wall to the thickness of the first side wall proximate the rearward lower corner of the bolster opening and adjacent the bottom wall of the side frame is between about 1.05:1 and 1.71:1.

31. The side frame for a railway car truck of claim 28, wherein a ratio of the thickness of the bolster opening wall proximate the forward upper corner of the bolster opening adjacent the first side wall to the thickness of the bolster opening wall proximate the forward upper corner of the bolster opening in a central portion of the bolster opening wall is between about 1.05:1 and 1.59:1; and wherein a ratio of the thickness of the bolster opening wall proximate the rearward upper corner of the bolster opening adjacent the first side wall to the thickness of the bolster opening wall proximate the rearward upper corner of the bolster opening in the central portion of the bolster opening wall is between about 1.05:1 and 1.59:1.

32. The side frame for a railway car truck of claim 28, wherein a ratio of the thickness of the first side wall proximate the forward upper corner of the bolster opening and adjacent the bolster opening side wall to the thickness of the first side wall proximate the forward upper corner of the bolster opening and adjacent a top wall of the side frame is between about 1.55:1 and 2.73:1; and wherein a ratio of the thickness of the first side wall proximate the rearward upper corner of the bolster opening and adjacent the bolster opening side wall to the thickness of the first side wall proximate the rearward upper corner of the bolster opening and adjacent the top wall of the side frame is between about 1.55:1 and 2.73:1.

33. The side frame for a railway car truck of claim 28, wherein a ratio of the thickness of the forward pedestal jaw walls proximate the upper inboard corner of the forward pedestal jaw and adjacent the first side wall to the thickness of the forward pedestal jaw wall proximate the upper inboard corner of the forward pedestal jaw in a central portion of the forward pedestal jaw wall is between about 1.05:1 and 1.86:1; and wherein a ratio of the thickness of the rearward pedestal jaw walls proximate the upper inboard corner of the rearward pedestal jaw and adjacent the first side wall to the thickness of the rearward pedestal jaw wall proximate the upper inboard corner of the rearward pedestal jaw in a central portion of the rearward pedestal jaw wall is between about 1.05:1 and 1.86:1.

34. The side frame for a railway car truck of claim 28, wherein a ratio of the thickness of the first side wall proximate the upper inboard corner of the forward pedestal jaw and adjacent the forward pedestal jaw wall to the thickness of the first side wall proximate the upper inboard corner of the forward pedestal jaw and adjacent a top wall of the side frame is between about 1.18:1 and 3.20:1; and wherein a ratio of the thickness of the first side wall proximate the upper inboard corner of the rearward pedestal jaw and adjacent the rearward pedestal jaw wall to the thickness of the first side wall proximate the upper inboard corner of the rearward pedestal jaw and adjacent the top wall of the side frame is between about 1.18:1 and 3.20:1.

* * * * *